US007766511B2

(12) United States Patent
Zampini et al.

(10) Patent No.: US 7,766,511 B2
(45) Date of Patent: Aug. 3, 2010

(54) LED LIGHT FIXTURE

(75) Inventors: Thomas L. Zampini, Goshen, CT (US); Thomas L. Zampini, II, Goshen, CT (US); Mark A. Zampini, Goshen, CT (US)

(73) Assignee: Integrated Illumination Systems, Morris, CT (US)

( * ) Notice: Subject to any disclaimer, the term of this patent is extended or adjusted under 35 U.S.C. 154(b) by 349 days.

(21) Appl. No.: 11/739,470

(22) Filed: Apr. 24, 2007

(65) Prior Publication Data

US 2007/0247842 A1 Oct. 25, 2007

Related U.S. Application Data

(60) Provisional application No. 60/794,819, filed on Apr. 24, 2006.

(51) Int. Cl.
*F21V 29/00* (2006.01)

(52) U.S. Cl. ..... 362/294; 362/373; 362/404

(58) Field of Classification Search ..... 362/294, 362/547, 373, 404, 153
See application file for complete search history.

(56) References Cited

U.S. PATENT DOCUMENTS 6,238,065 B1 5/2001 Jones
6,253,530 B1 7/2001 Price et al.
7,198,387 B1 * 4/2007 Gloisten et al. ..... 362/294
2006/0002142 A1 * 1/2006 Jeong et al. ..... 362/612
2006/0098441 A1 * 5/2006 Chou ..... 362/294

OTHER PUBLICATIONS

Hexcel Composites, "Sandwich Panel Fabrication Technology", Web Address: http://www.hexcel.com/NR/rdonlyres/B4574C2C-0644-43AC-96E2- CC15967A4B05/0/4547_Sandwich_Fabrication.pdf, Jan. 1997.

Bellcomb Technologies Incorporated, "Edges, Joiners, Attachments", Web Address: http://www.bellcomb.com/caps/edges.htm, Apr. 22, 2007.

* cited by examiner

*Primary Examiner*—Laura Tso
(74) *Attorney, Agent, or Firm*—Choate, Hall & Stewart LLP; Christopher J. McKenna

(57) ABSTRACT

A light fixture using LEDs includes a lower skin layer possessing heat transfer properties. A circuit board is affixed to the lower skin layer, and a single LED, or a plurality of LEDs, is electrically connected to the circuit board. The single LED, or plurality of LEDs, when electrically activated, emits light through substantially around a vertical axis. The light fixture also includes a core possessing heat transfer properties that is in thermal contact with the LED and has an interior cavity for the LED. The core is affixed to the lower skin layer, and an upper skin layer, containing a window or windows over the LED or LEDs, is affixed to the core. The LEDs may be white, infrared, ultraviolet, and/or colored and may be mounted on a printed circuit board or individually.

34 Claims, 22 Drawing Sheets

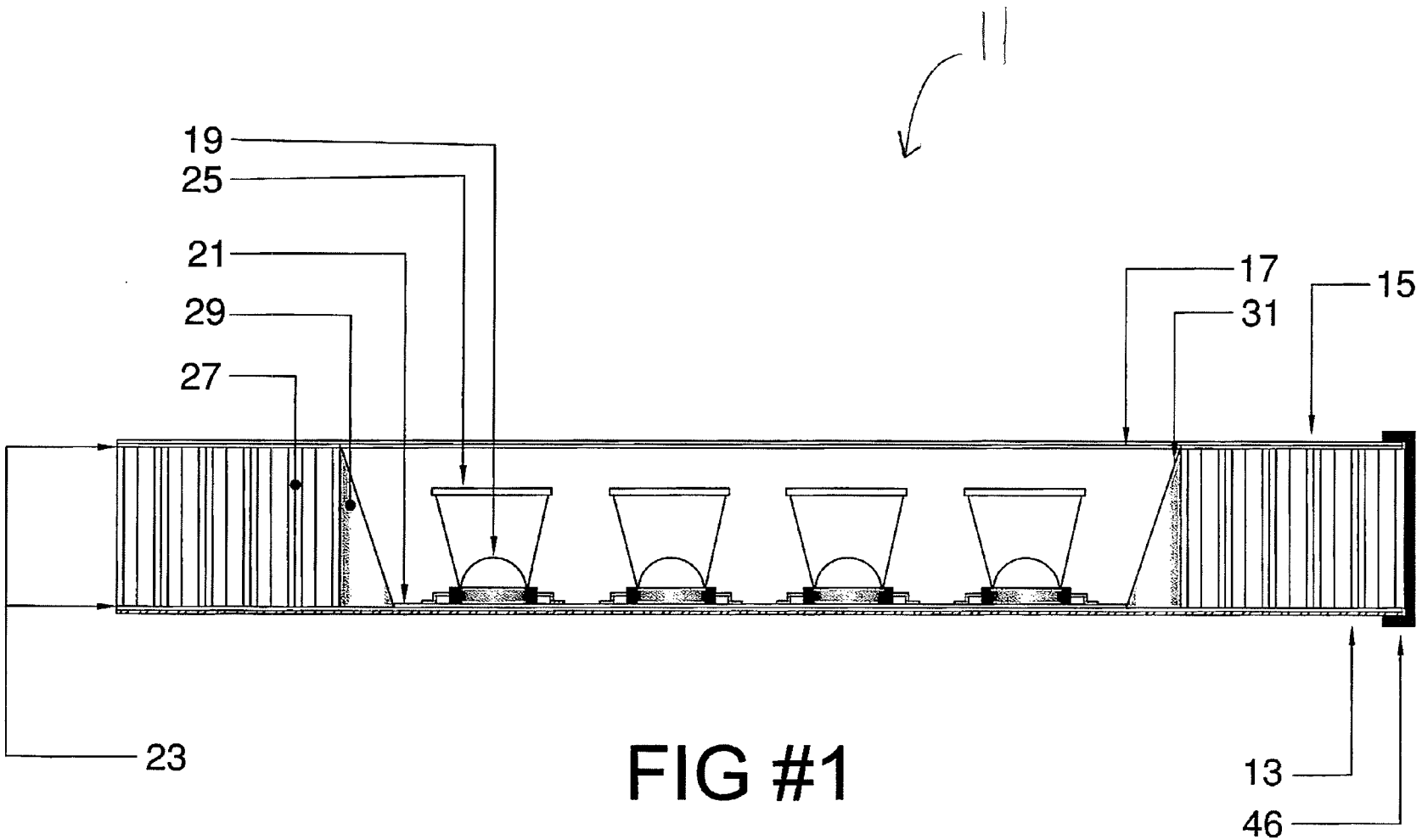
FIG #1

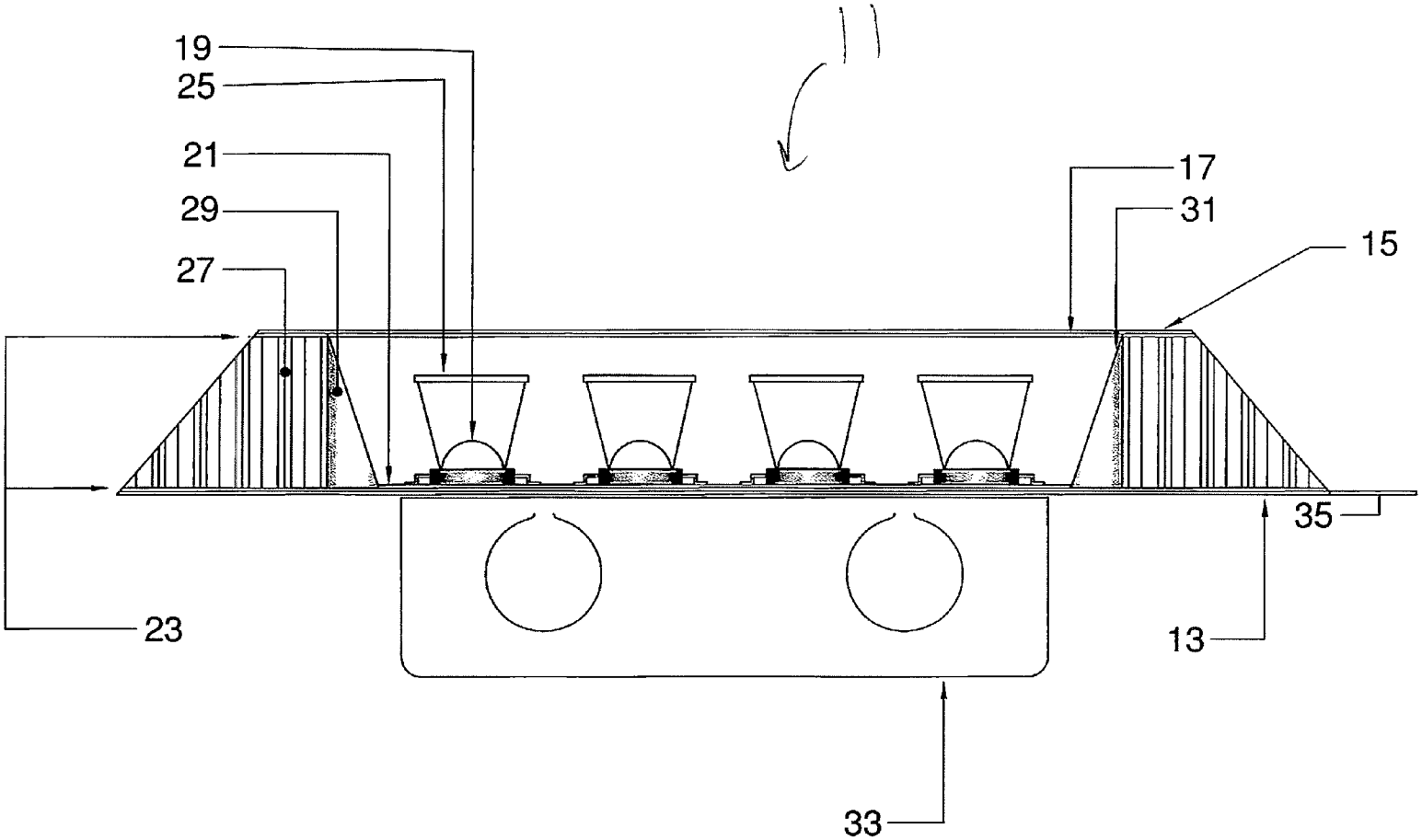
FIG #2

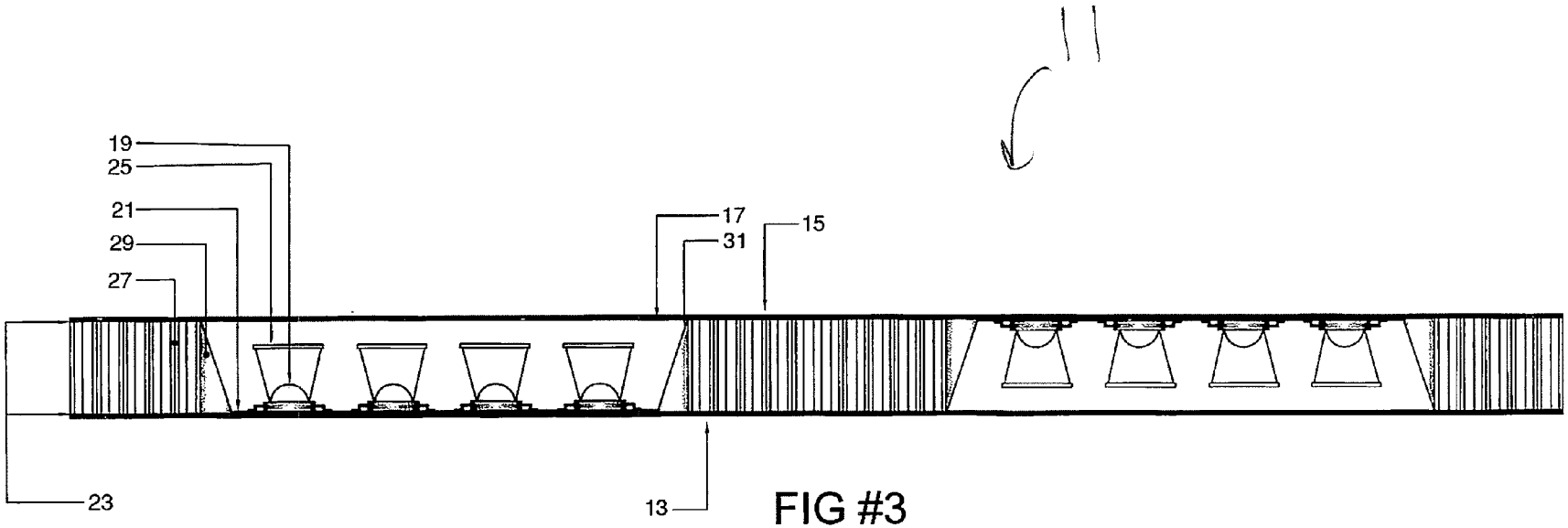
FIG #3

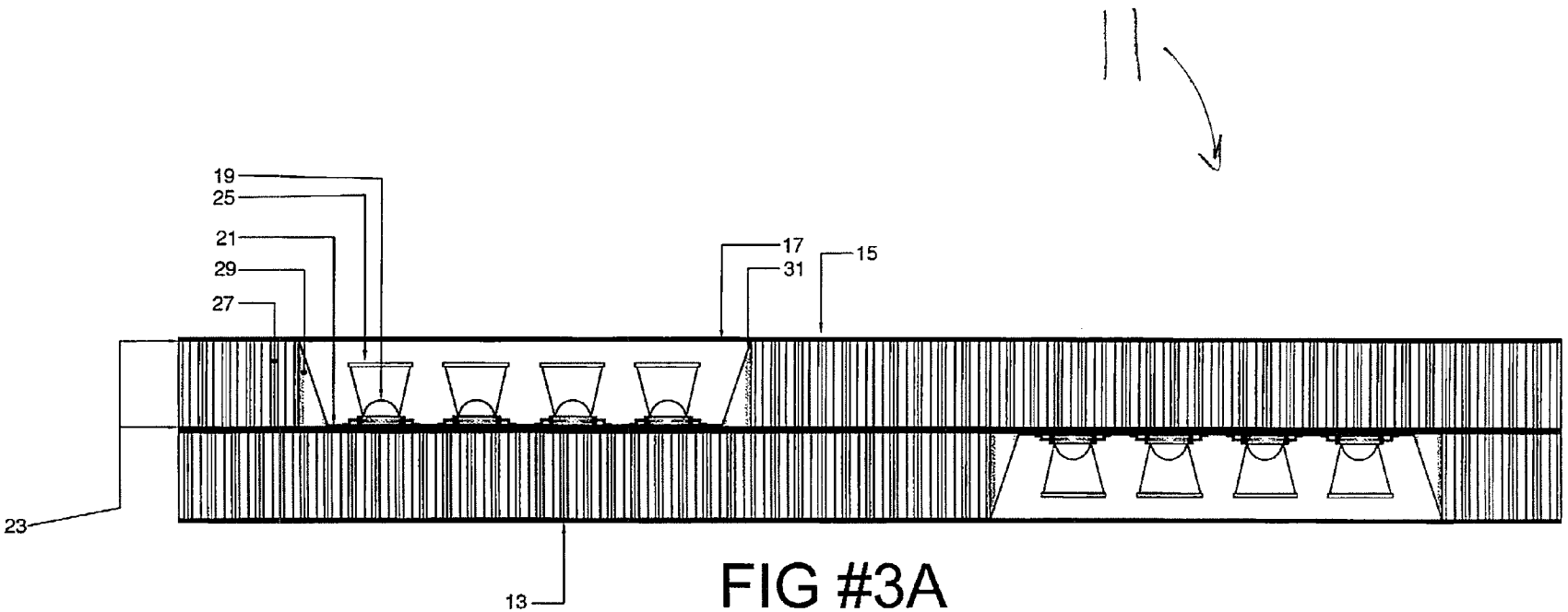
FIG #3A

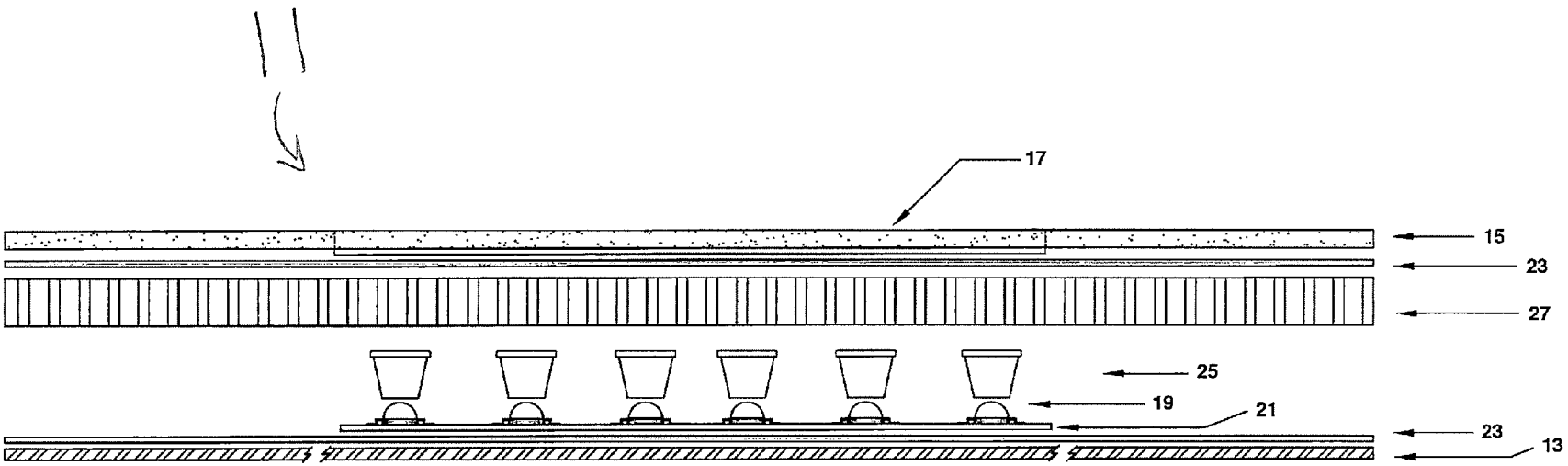
FIG #4

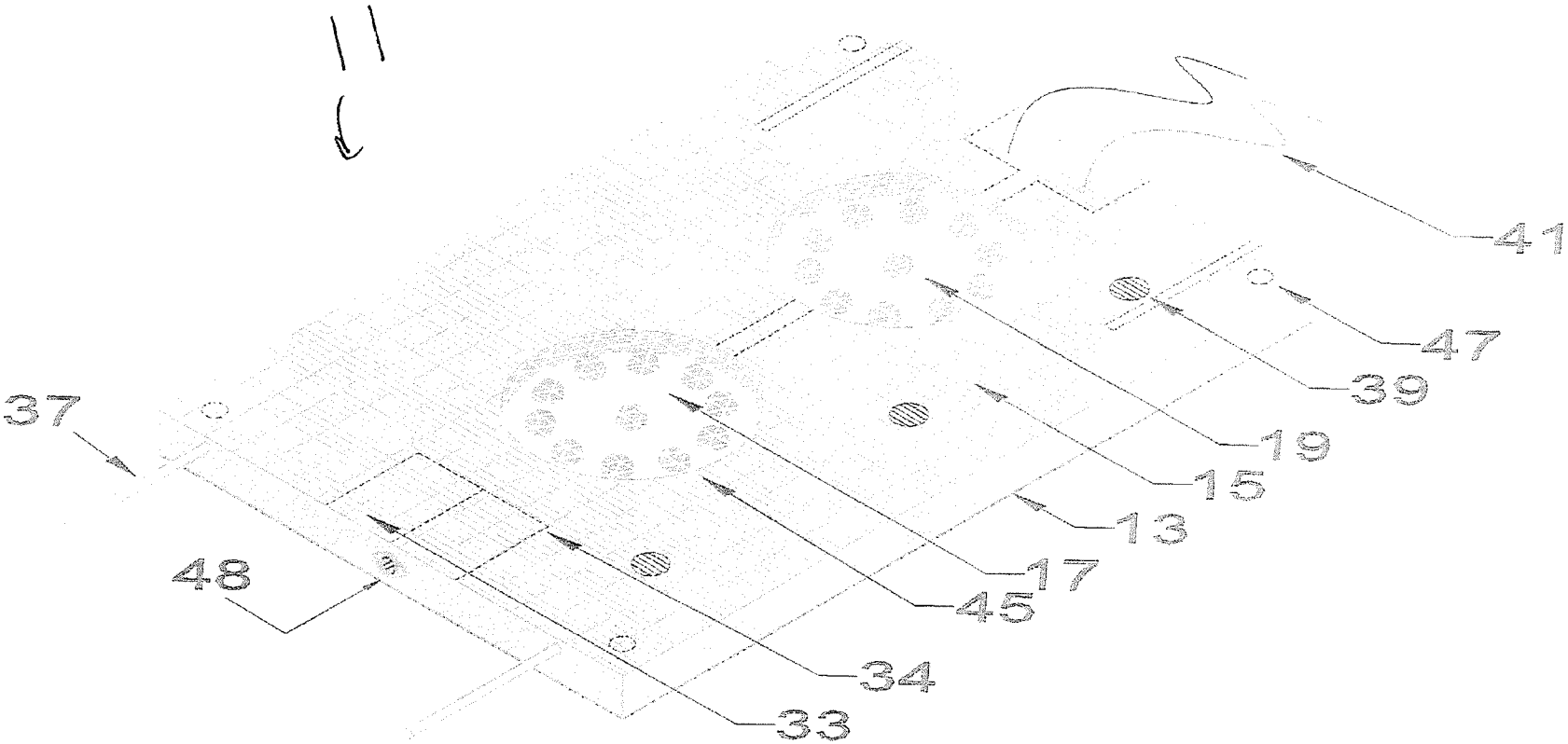
FIG#5

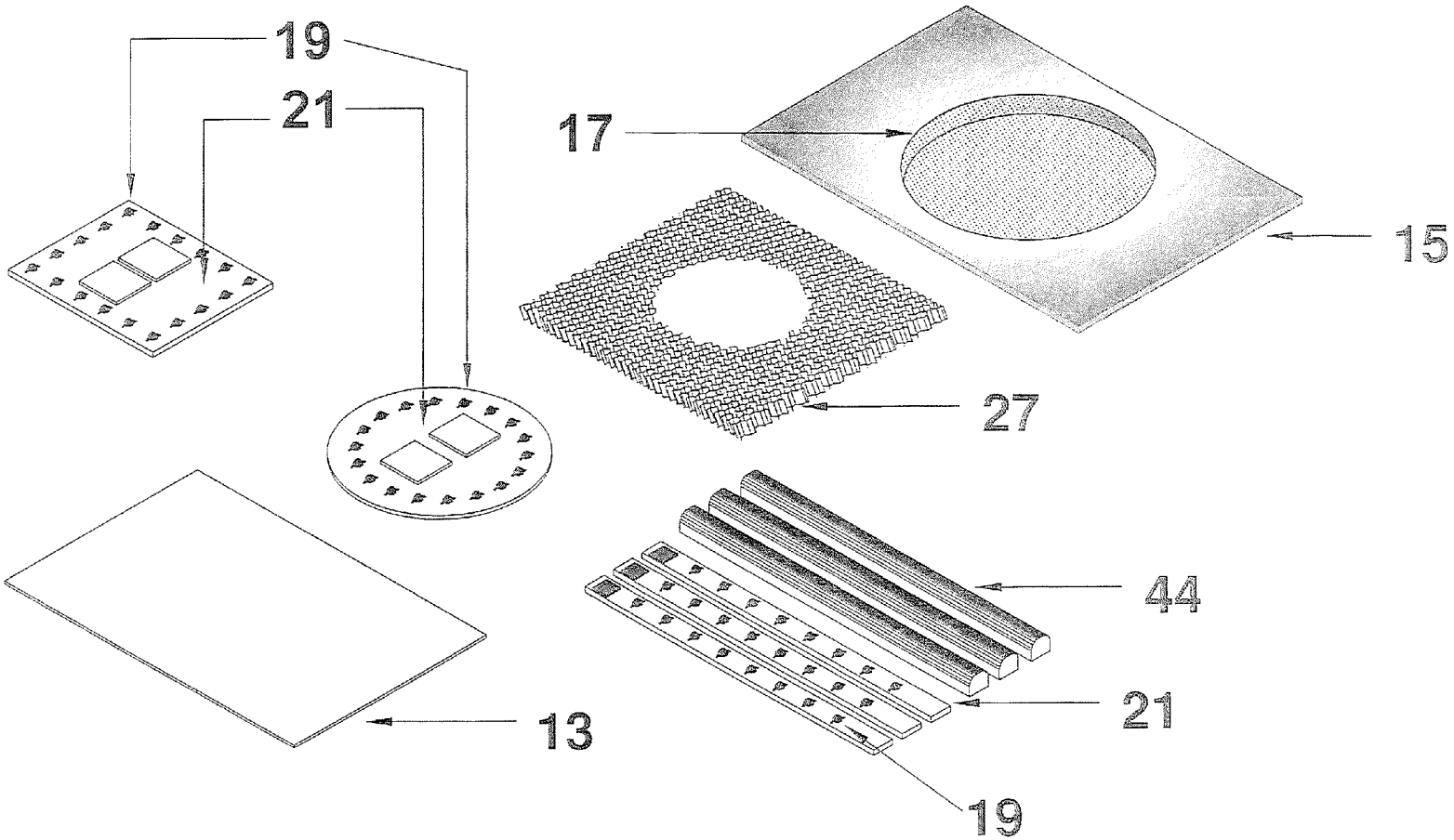
FIG #6

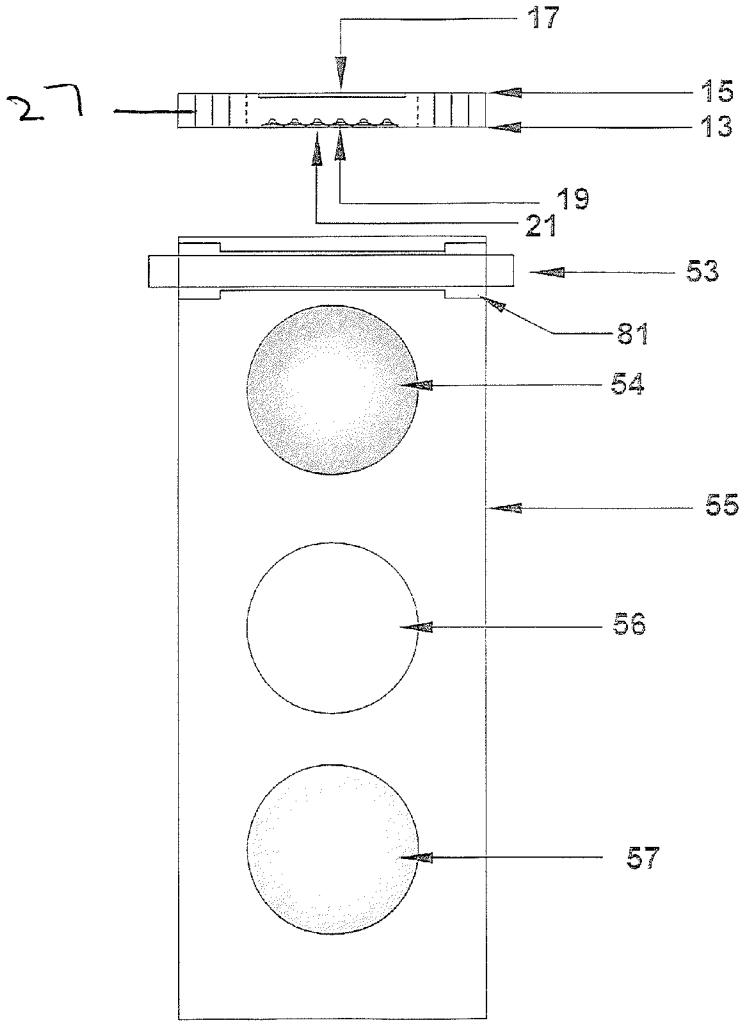
FIG #11

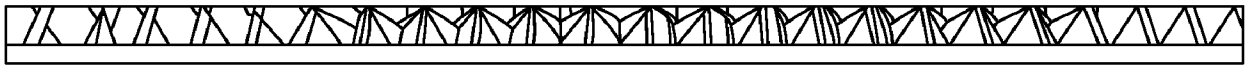
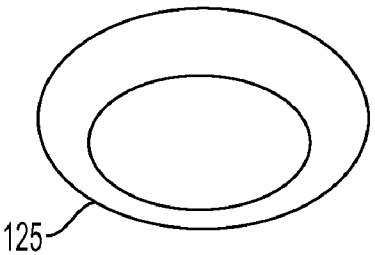
FIG. 17

LED LIGHT FIXTURE

CROSS REFERENCED TO RELATED APPLICATION

This application claims the benefit of U.S. Provisional Application Ser. No. 60/794,819, filed on Apr. 24, 2006, hereby incorporated by reference in its entirety.

FIELD OF THE INVENTION

The present invention relates to a diversified LED fixture/panel, which can be of any size, geometric shape, flat, formed or combination thereof. The fixtures/panels may stand alone, be stacked, or be joined. The fixture/panel can be a structural or decorative panel. More particularly, it relates to an LED lighting system, which contains all necessary standardized components in a simplified lightweight fixture/panel. AC or DC voltage may be connected to the fixture panel which comprises of internal connectors, contacts, round conductive pins or wire connections, and any required on board circuits.

BACKGROUND OF THE INVENTION

As shown in FIG. 1A, light emitting diodes (LEDs) 19 work by connecting a power source to terminal pins 3 and sending the current in the right direction through a simple semiconductor 5. The interaction that occurs when this happens generates light. The ends of the terminal pins 3 and semiconductor 5 are housed in a hemispherical dome 7, bulb, or any other configuration, as shown in FIG. 1A, which concentrates the light emitted as it bounces off the sides and through the top. Thus, the light emitted is substantially around a vertical axis 9. As can be seen, LEDs do not have a filament that can burn out and does not generate heat during operation.

Popular conventional lighting systems use either an incandescent or fluorescent source. When these light sources expire, they must be replaced. The typical life of a fluorescent bulb is 10,000 to 20,000 hours. An incandescent bulb lasts only 2,000 hours, and about ninety percent of the electricity used by incandescent bulbs is lost as heat. Conventional light fixtures are heavy in weight, difficult to manufacture, and have many replacement components as ballasts, which are potential failures in addition to the fluorescent bulb.

In contrast, light emitting diodes do not burn out. Instead, they gradually degrade in performance over time. For example, some LED products are predicted to still deliver an average of 70% of initial intensity after 50,000 hours of operation. At 12 hours per day, 365 days per year, this amounts to a lifetime of 11 years with only 30% degradation (70% lumen maintenance) from initial luminous output and no catastrophic failures.

LEDs last ten years longer than any conventional light sources, and these solid state devices have no moving parts, no fragile glass, no mercury, no toxic gases, and no filament. There is nothing to break, rupture, shatter, leak, or contaminate.

LEDs are more energy efficient, are safe to touch since they remain cool, provide instant light, and are available in white, green, blue, royal blue, cyan, red, red orange, and amber.

Also, LEDs produce directional light unlike conventional light sources that emit light in all directions, which causes a loss of intensity. Typical losses range from 40% to 60% of the light generated. The direct nature of LEDs can result in efficiencies of 80% to 90%. This results in reduced maintenance costs by eliminating or practically reducing the frequency of required maintenance.

LEDs have many other desirable features. They are fully dimmable without color variation. They instantly turn on, have full color, and provide 100% light. LEDs have no mercury in the light source and no heat or UV in the light beam. LEDs are capable of starting cold and low voltage DC operation. LEDs can be binned for photometric luminous, flux (LM), color, wavelength, radio metric power, and forward voltage.

LED benefits are based on good thermal system design to achieve the best efficiency and reliability. The LED absolute maximum thermal ratings must be maintained for LED junction and aluminum printed circuit board temperature. The LED requires heat management in order to achieve maximum rated life. Thermal resistance causes a temperature difference between the source of the heat and the exit surface for heat. The less heat retained by the LED the more enhanced its performance and lifetime.

Despite the advantages of LEDs, current designs have several problems. In present LED products and designs, the panels or fixtures are heavy in weight, expensive, and difficult to manufacture and install, and are not rugged or impact resistant. Furthermore, the heat sinking is inadequate, most LED products are not waterproof, impact resistant, or antimagnetic. Moreover, they cannot be trimmed or cut to size, and the products experience reduced life spans due to LEDs exceeding manufacturers' specified required thermal temperature limits.

The present invention overcomes these issues. The present invention may package all necessary components in a lightweight panel with a connecting power wire to the outside of the panel for easy installation. It also manages heat, which increases the life span of the LED light fixture/panel. The present invention may also be waterproof, flame resistant, impact resistant, and antimagnetic. In addition, it can be formed and cut to any size.

SUMMARY OF THE INVENTION

An object of the present invention is to provide a lighting fixture/panel, which use a single LED or a plurality of LEDs to produce an equivalent amount of light but use less energy when compared to conventional lighting fixtures.

Another object of the present invention is to package all or any of the electronic system components, wiring, optical components, reflectors, LED drivers, printed circuit board assemblies, batteries, battery back up circuitry, alarm circuitry, power supplies, wireless transmitter, diffusers, motion detectors, and cameras in a lightweight panel.

Still another object of the present invention is to operate in a variety of environments, including ones that are not suitable for conventional fixtures or panels due to their weight, installation problems, low thermal conduction, and low shock and corrosion resistance.

Yet another object of the present invention is to provide an LED fixture/panel that is low cost, waterproof, shock proof, fire resistant, acoustical, impact resistant, easy to assemble, and provides EMI shielding.

Still another object of the present is to provide a decorative panel/fixture that does not require extreme thermal conductivity and rigid structural integrity. The core of the panel may be less dense, have less core or heat conductive foam, and the outside upper skin may be a clear window or other material. This configuration may allow indirect and direct light distribution and low power LEDs.

Still another object of the present invention is to form the metal skin into custom shapes and sizes, which allows the standardization of all the system components and materials.

The shapes may be a flat or three-dimensional rectangular, square, circle, octagon, hexagon, pyramid, triangle, right angle, or custom shape.

According to one aspect of the present invention, a light fixture using LEDs includes a lower skin layer possessing heat transfer properties. A circuit board is affixed to the lower skin layer, and an LED is electrically connected to the circuit board. The LED, when electrically activated, emits light substantially around a vertical axis. The light fixture also includes a core possessing heat transfer properties that is in thermal contact with the LED and has an interior cavity for the LED. The core is affixed to the lower skin layer, and an upper skin layer containing a window over the LED is affixed to the core.

According to another aspect of the present invention, a light panel/ fixture using LEDs includes a lower metal skin layer possessing heat transfer properties. A printed circuit board is affixed to the lower skin, and the LEDs are bonded and soldered to the circuit board. When a DC voltage is applied to the LED or LEDs, they emit light through a window, which may be a hemispheric dome or other configurations based on the light emission angle desired. The light panel/fixture also includes a core possessing heat transfer properties that is in thermal contact with the LED or LEDs. The core is affixed to the lower skin layer and an upper skin layer containing a window over the LED. The LEDs conduct the heat from the lower skin through the core to the upper skin. This increases the thermally conductive surface area.

According to another aspect of the present invention, additional skin layers and cores may be between the upper and lower skin layers. This configuration allows more heat to be conducted to the upper skin and the lower skin through the core. This also allows for more high power LED applications. This configuration also allows light distribution to be vertically upward and vertically downward. In addition, more internal area is allowed for additional electronic and mechanical components.

Another aspect of the present invention is a light panel/ fixture using LEDs, which includes a lower skin layer formed to a right angle and possessing heat transfer properties. A printed circuit board is affixed to the lower skin layer, and the LEDs are connected to the circuit board. When a DC voltage is applied to the LED or LEDs, they emit light through a window, which may be a hemispheric dome or other configurations based on the light emission angle desired. The light panel/fixture also includes a core possessing heat transfer properties that is in thermal contact with the LEDs and affixed to the lower skin layer. The upper skin is also affixed to the core and formed at a right angle as well.

Another important aspect of the present invention is the use of LEDs, lenses, reflectors, geometric forms, graphic films, and shapes to direct the light distribution to the edges of the panel and through windows of the present invention to indirectly distribute and transmit light.

Another aspect of the present invention is to be interfaced, added on, or mounted to in any plane to a prior art panel such as flat honeycombs panels with any type prior art construction.

Another aspect of the invention is to use prior art fasteners, and edging systems such as solid, tube, "C" channel, channel molding, end cap, formed edge, compound edge, fill, or custom extrusion.

Yet another aspect of the invention is to use existing art joint panel joiners such as spline joint, "H" channel, camlock, mechanical angles, bolts and washers, sleeve insert, 90 degree and 45 degree corner extrusion, cap channel or custom corner.

Yet another aspect of the present invention is to be used and interchanged with prior art suspended and tile floors.

BRIEF DESCRIPTION OF THE DRAWINGS

FIG. 1 is a simplified schematic side view of an LED light fixture/panel provided in accordance with the present invention.

FIG. 2 is a simplified schematic side view of an LED light fixture mounted to a four gang electrical box in accordance with the present invention.

FIG. 3 is a simplified schematic side view of an alternative embodiment of an LED light fixture provided in accordance with the present invention.

FIG. 3A is a simplified schematic side view of an alternative embodiment of an LED light panel provided in accordance with the present invention.

FIG. 4 is an exploded view of an LED light fixture provided in accordance with the present invention.

FIG. 5 is a simplified three-dimensional illustration of an exterior view of an LED light fixture/panel provided in accordance with the present invention.

FIG. 6 illustrates the separate components of an LED light fixture provided in accordance with the present invention.

FIG. 8 is a simplified schematic of a front view of an alternative embodiment of an LED light fixture/panel in accordance with the present invention.

FIG. 9 is a simplified schematic of a front view of an alternative embodiment of an LED light fixture/panel in accordance with the present invention.

FIG. 10 is a simplified schematic of a front view of an alternative embodiment of an LED light fixture/panel in accordance with the present invention.

FIG. 11 is a simplified schematic of an exterior view of an LED light fixture/panel side view of an alternative embodiment provided in accordance to the present invention.

FIG. 12 is a simplified schematic side view of an LED light fixture/panel of an alternative embodiment in accordance with the present invention.

FIG. 16 is a simplified schematic side view of an alternative embodiment of an LED light fixture/panel in accordance with the present invention.

FIG. 17 is a two dimensional figure of an alternative embodiment in accordance with the present invention.

DETAILED DESCRIPTION OF THE PREFERRED EMBODIMENT

Figure 1A:
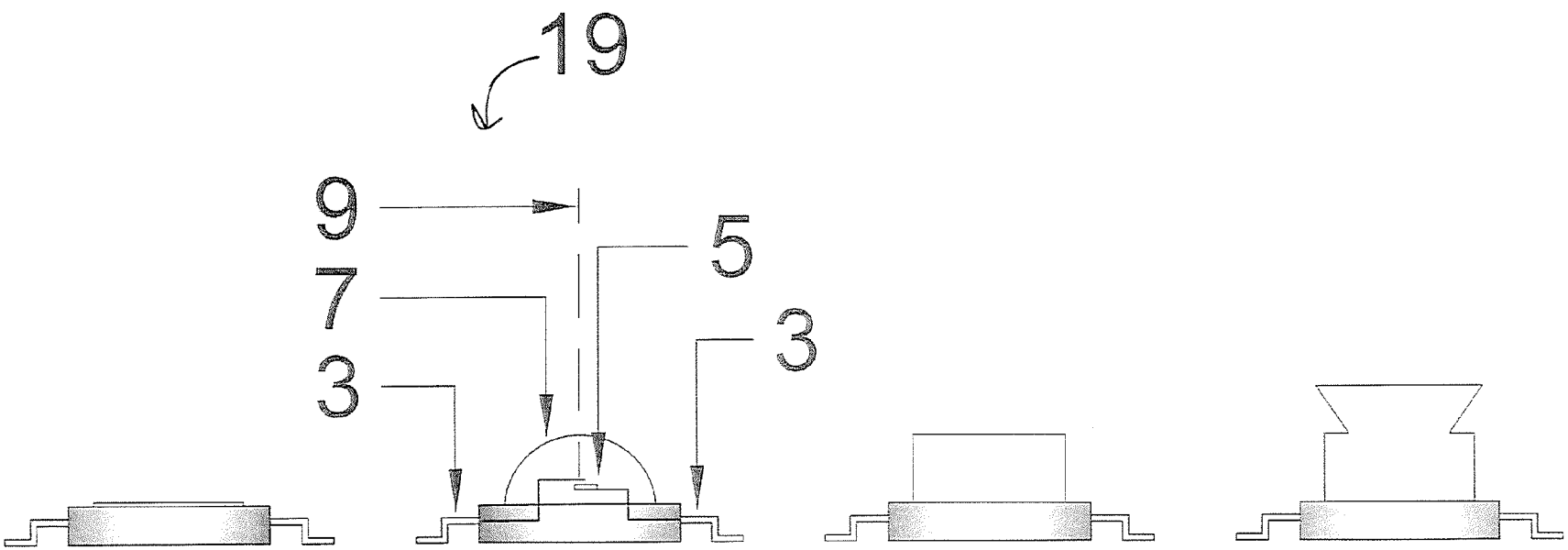
FIG. 1A is a simplified schematic side view of an LED.

The present invention is directed to LED lighting structures that contain all the necessary functional components in a lightweight, sturdy panel or fixture. FIGS. 1, 2, and 3 show three embodiments of the present invention in a simplified schematic form. In FIGS. 1, 2, and 3, an LED light fixture/panel is encapsulated by a lower skin layer 13 and an upper skin layer 15. The lower skin layer 13 and upper skin layer 15 may be made in formed or flat configurations. A single or plurality of LEDs 19 is connected to a printed circuit 21 and is attached to the lower skin layer 13 by an adhesive, epoxy or thermal film 23. Also attached by adhesive, epoxy or thermal film 23 to the lower skin layer 13 is the core 27. Attached to the core by adhesive, epoxy or thermal film 23 is an upper skin layer 15.

The LEDs 19 have and optical component 25 and reflector 31. The upper skin 15 and the lower skin 13 may be flat or formed. The lower skin layer 13 can be of any thickness. Preferably, it has a thickness from 0.010 to 0.500 inches. The lower skin layer 13 may also be made of plastic, metal, or a combination of the two. If metal, it is preferably aluminum. The lower skin layer 13 can actually be made of any material with proper heat transfer properties. Some examples include aluminum and copper.

The upper skin layer 15 can also be of any thickness. Preferably, it has a thickness from 0.010 to 0.500 inches. The upper skin layer 15 may be made of plastic, metal, or a combination of the two. If metal, it is preferably aluminum. The upper skin layer 15 may also be textured or have other decorative materials or graphic film added to it. There may also be an additional skin layer added to the upper skin layer 15.

Figure 7:
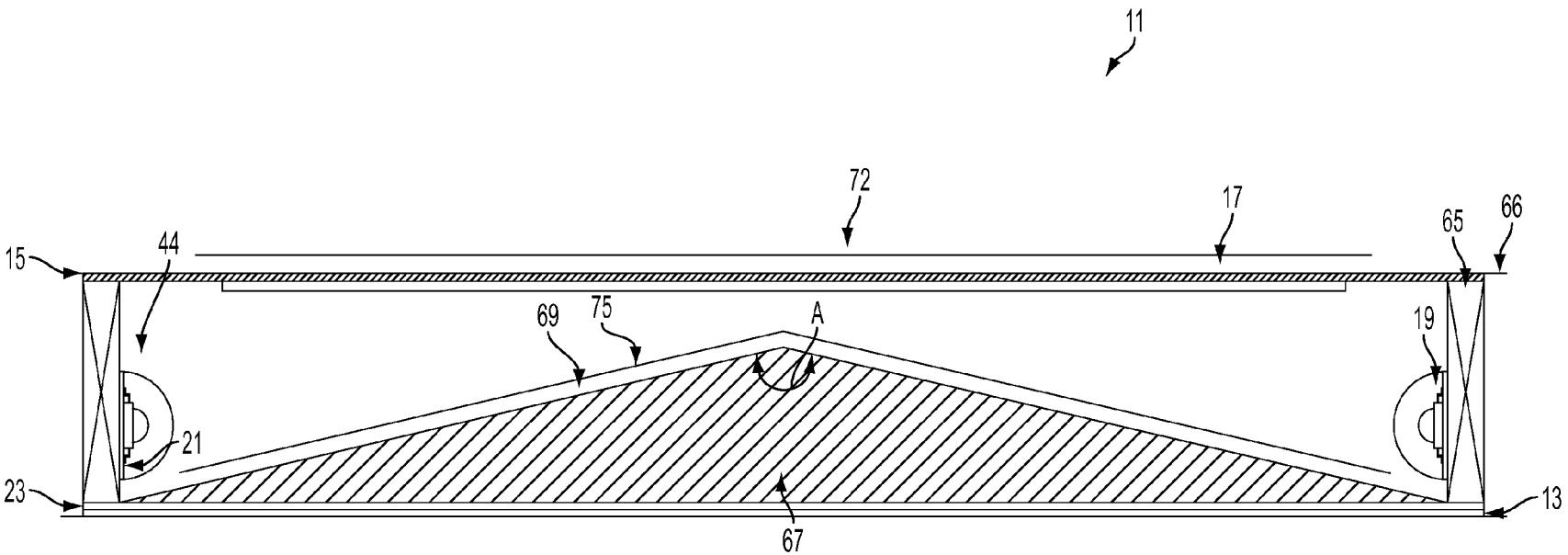
FIG. 7 is a simplified schematic of a front view of an alternative embodiment of an LED light fixture/panel in accordance with the present invention.
Figure 7A:
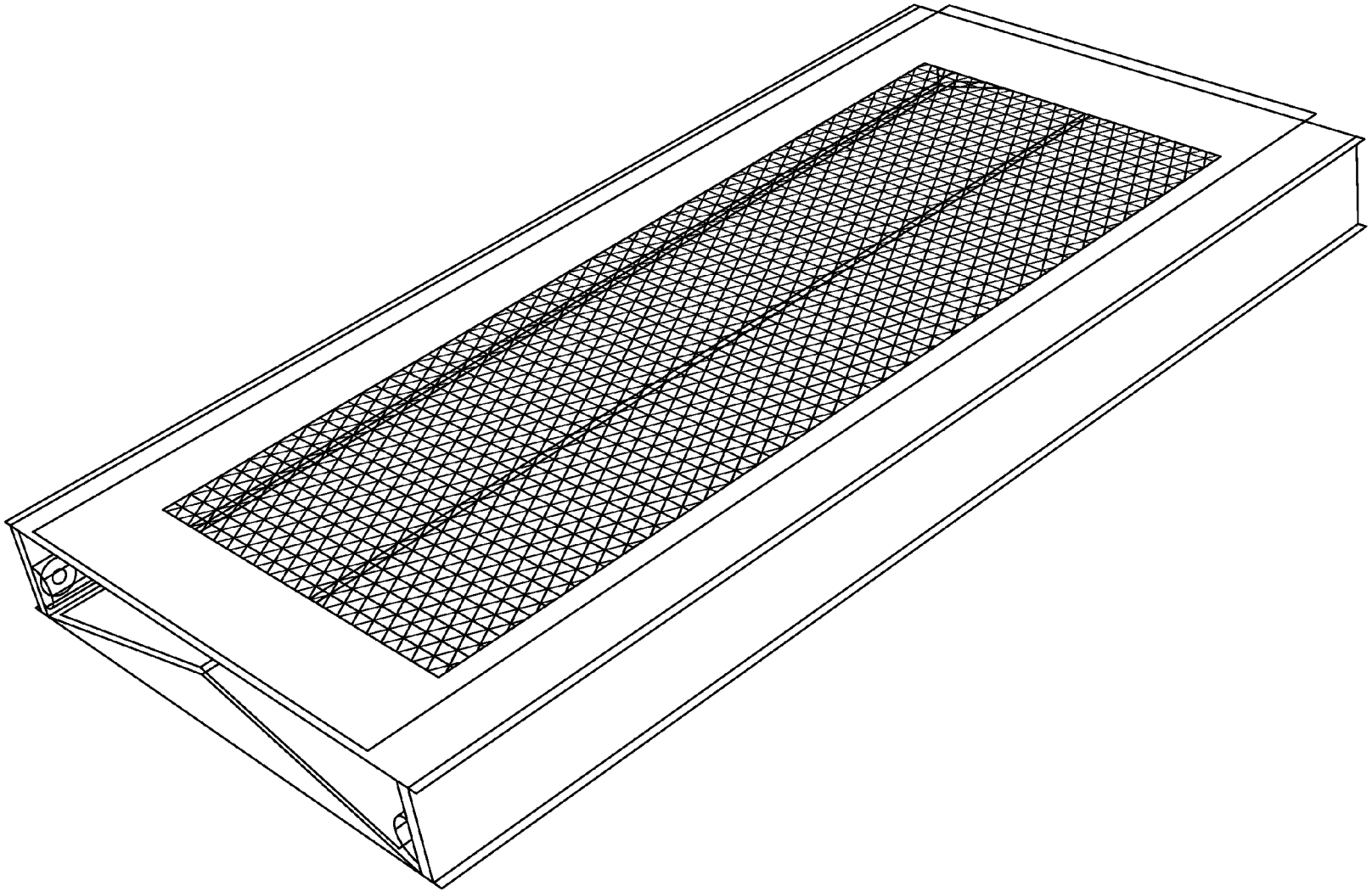
FIG. 7A is a three dimensional view of an alternative embodiment of an LED light fixture/panel in accordance with the present invention.

The upper skin layer 15 also includes a window 17 above the LEDs 19 so that light may transmit from the fixture/panel 11. Window 17 may include clear windows, diffusers, or refractors for direct or indirect transmission of light. The window 17 may have a graphic or luminous, film applied. Also, the window 17 may be a flexible substrate 72 as shown in FIG. 7. The window may have parabolic, louvered, or baffles of various cell sizes and shapes attached to it.

The upper skin layer 15 also may include a window 17 or several windows 17 as shown in FIG. 5. Window 17 may include clear, diffusers, prismatic patterns, or refractors for the direct or indirect transmission of light.

As seen in FIG. 3, the upper skin layer 15 may include a single LED or a plurality of LEDs 19 electrically connected to a printed circuit board 21 and attached to the upper skin layer 15 by adhesive, epoxy or thermal film 23. This configuration allows light distribution vertically upward and vertically downward.

Internal to the lower skin layer 13 may be one or more circuit boards 21. The circuit board 21 may be metal core printed circuit boards, flex circuits, molded, or custom printed circuit boards. The printed circuit board may have on board LED drivers and thermal monitoring circuitry. The circuit board 21 is affixed to the lower skin layer 13. Preferably, the circuit board 21 is affixed to the lower skin layer 13 by a thermally conductive and waterproof adhesive epoxy or thermal film 23.

The circuit board 21 may be in many shapes, sizes, and configurations. The shapes may include circles, rings, rectangles, squares, diamonds, octagons, or custom shapes and thicknesses. The desired shapes may be thermally bonded by the adhesive epoxy or thermal film 23 to the lower skin layer 13. The circuit board 21 may be designed with on board modular circuitry and drivers as required by each application.

Connected to the circuit board 21 are the LEDs 19. LEDs 19 can be configured into any pattern. The LEDs 19 may be made by any manufacturer and could be any style and package that LEDs may have in the future. For example, LEDs 19 may be mounted on the circuit board 21 in a square, round, or line pattern. Optical component 25 surrounds the LEDs 19. Any type of optical component can be incorporated. Optical components 25 may cover single or multiple LEDs 19 and may be of any shape. For example, lenses can be used for light distribution, collimation, or a diffuser could be used to achieve a uniform light. Optical component 25 or 44 can be used to direct or focus the light.

The core 27 is located between the lower skin layer 13 and the upper skin layer 15. The core 27 is attached to the lower skin layer 13 and the upper skin layer 15 by adhesive epoxy or thermal film 23. The core 27 may be of any thickness. Preferably, the core 27 is 0.250 to 6.00 inches thick. The core 27 can be made of any material with proper heat transfer properties. For example, aluminum or copper would be acceptable material for core 27. Core 27 may be various configurations of density, cell sizes, and shapes to increase or decrease thermal conductivity and strength or may be of custom shapes.

The main structural core 27 inside the lower skin layer 13 and upper skin layer 15 could be various structural shape configurations. For example, the configuration could be honeycomb, louvers, baffles, egg crate, channel, I beam, U channel, stand offs, threaded inserts, or any other shape. The LED light fixture 11 manages heat by using the panel and structure of the core 27 to conduct heat away from the LEDs 19. Reliability of LEDs 19 requires maintaining their junction temperature below manufacturers' specifications requirements. By conducting heat away from the LEDs 19, the present invention increases the time between replacements.

Figure 10A:
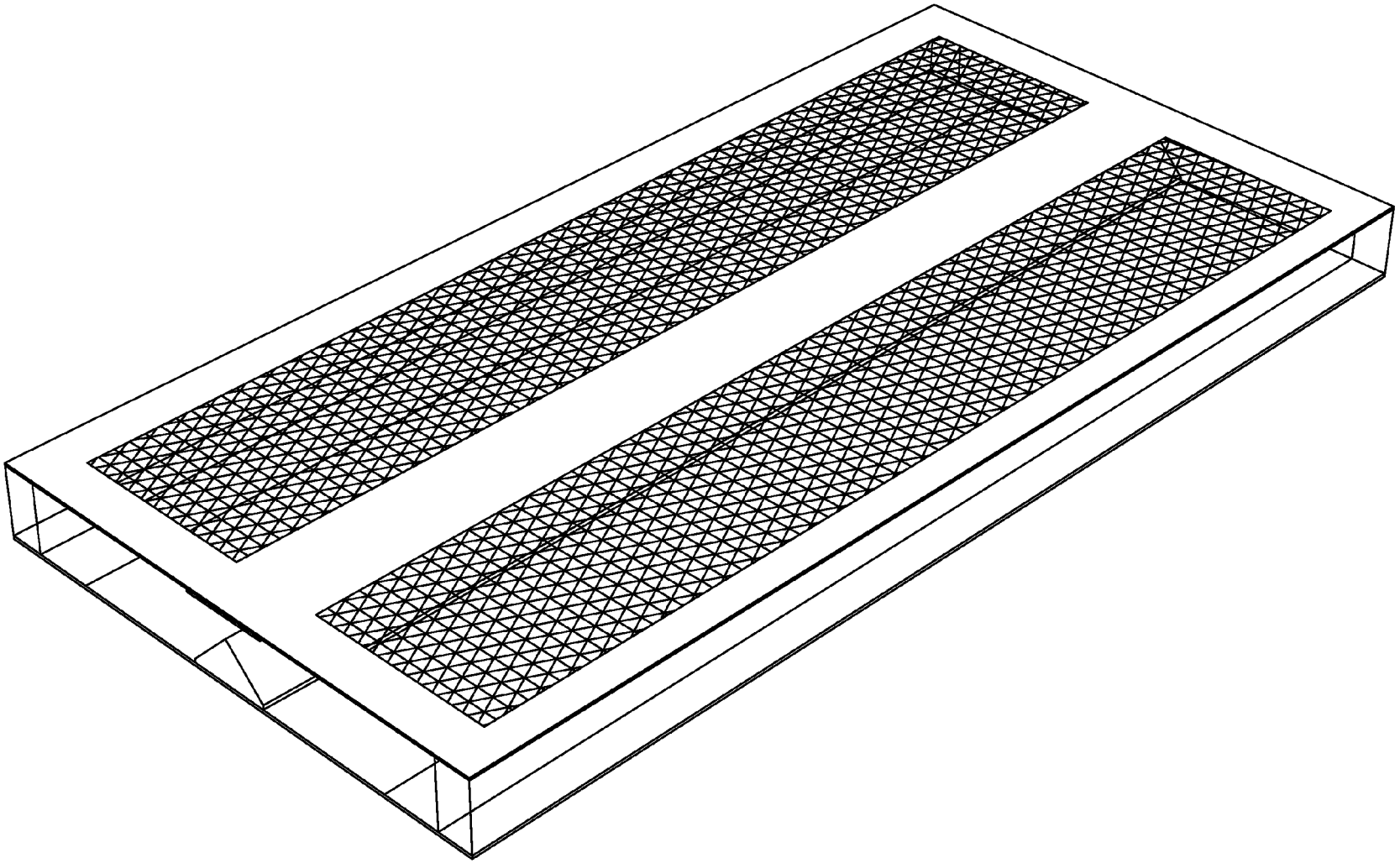
FIG. 10A is a three dimensional view of an alternative embodiment of an LED light fixture/panel in accordance with the present invention.

As shown in FIG. 10, other structures of plastic material types and shapes 60 such as acrylic, polycarbonate, laminates may be added between or on the surface of the lower skin layer 13 and upper skin layer 15. The clear plastic allows for edge illumination of the fixture/panel 11.

As shown best in FIG. 6, in the region of the LED light panel 11 where the LEDs 19 are located, the core 27 may be cut appropriately. A reflector 29 may be placed between the edge of the core 27 and the region where the LEDs 19 are located. The reflector 29 has a reflective surface 31 which also may be chemically coated for increased performance.

The combination of optical component 25 with a reflector 29 adds to the versatility of the present invention by changing the light direction and intensity of the LEDs 19. If optical component 25 is transparent or translucent, some stray light may not be properly directed by the optical component 25. In that case, the stray light bounces off reflector 29 into the proper direction. The reflection angle can be changed as required.

The outside edges of core 27 can also be cut as needed. For example, FIG. 2 shows the edge cut at an angle, and FIG. 3 shows the edge cut straight on the vertical. FIG. 1 has a decorative edge 46. The decorative edge 46 may be attached to any of the embodiments.

The LED light fixture/panel 11 also contains a modular power supply or supplies 33. The power supply 33 can be mounted inside the upper skin layer 15 and lower skin layer 13 or mounted externally on the fixture/panel 11. Other desired electrical items may be added to the interior or exterior of the panel/fixture 11. The power supply 33 voltage/wattage can be sized for the number of LEDs 19 in the panel/fixture 11. Power supply inputs may be any AC voltage. DC to DC voltage doublers or regulators may also be included for DC inputs to the panel.

Figure 13:
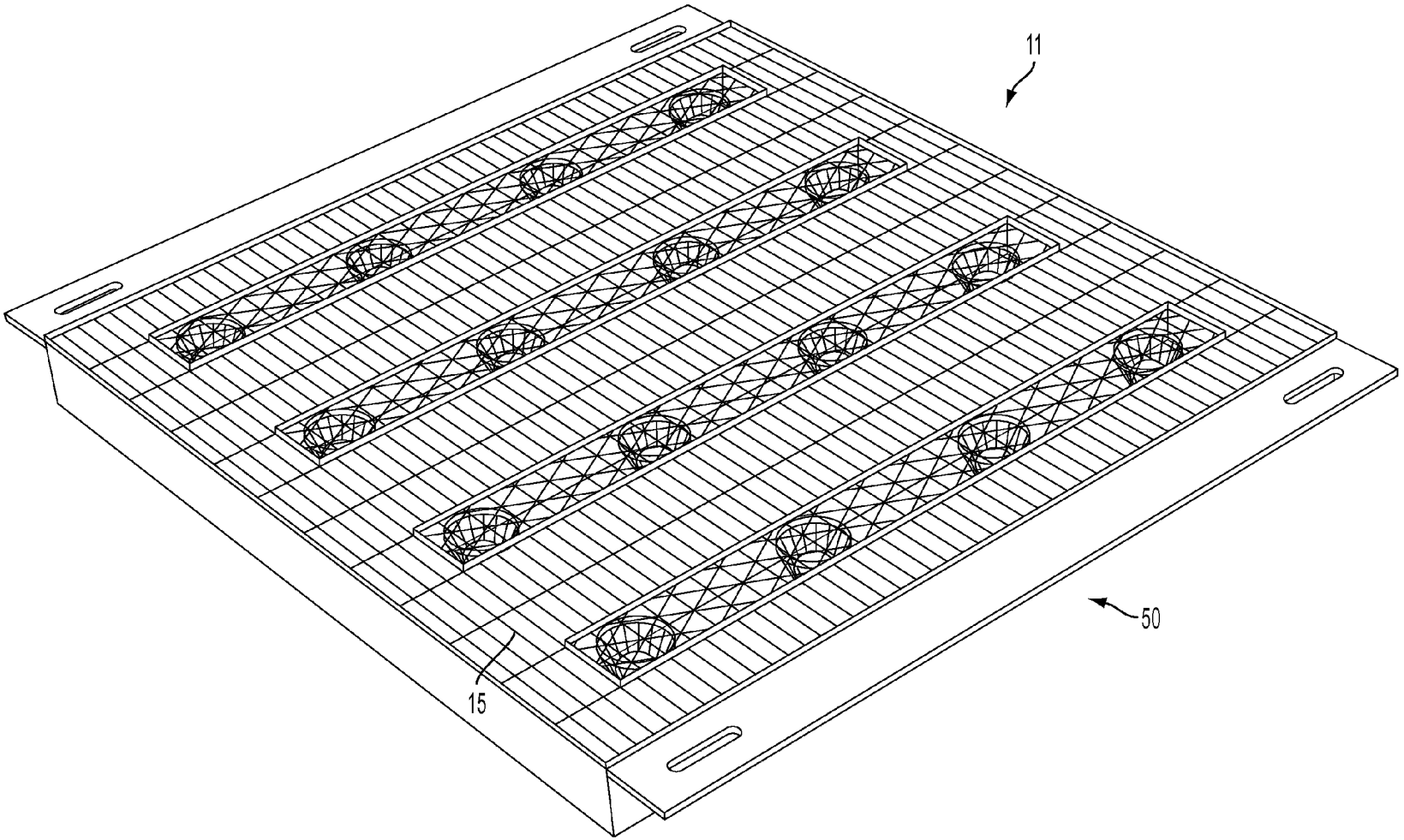
FIG. 13 is a three dimensional view of an alternative embodiment of an LED light fixture/panel in accordance with the present invention.
Figure 14:
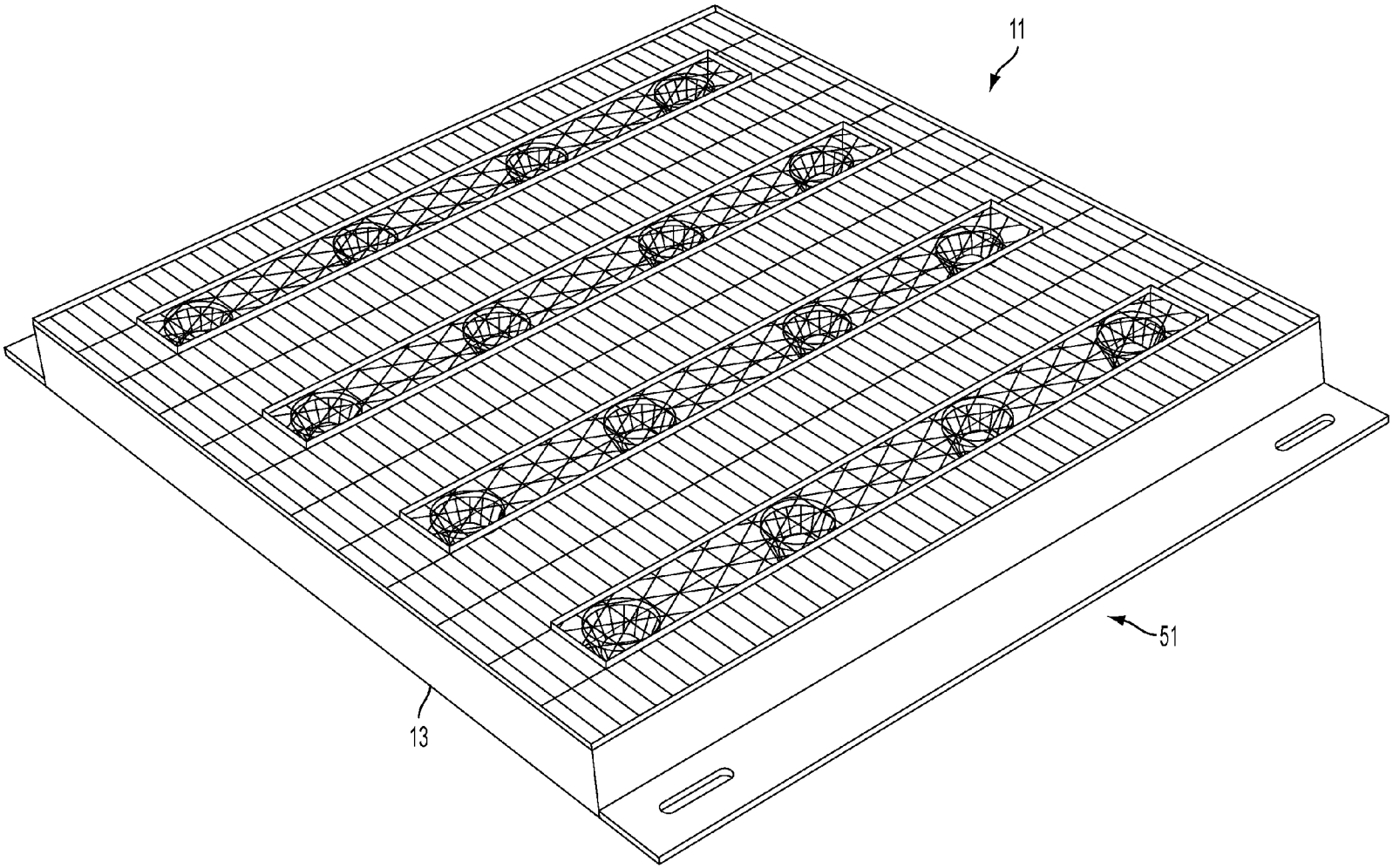
FIG. 14 is a three dimensional view of an alternative embodiment of an LED light fixture/panel in accordance with the present invention.

The LED light fixture 11 may also include mounting flange 35 for ease of installation. As shown in FIGS. 13 and 14, the flange may be reversed for flush mounting 50, 51. As shown in FIG. 5, standoffs 45 can be installed between the lower skin layer 13 for mounting holes 47 or securing other items to the panel fixture for mounting.

FIG. 4 shows each component of the present invention separated into layers. In FIG. 4, the LED light fixture includes the lower skin layer 13 as the bottom layer. The components above are affixed to the lower skin layer 13 by adhesive epoxy or thermal film 23. The adhesive epoxy or thermal film 23 affixes the lower skin layer 13 to the core 27 and circuit boards 21. The LEDs 19 may be electrically connected to the circuit boards 21, and the LEDs 19 are surrounded by optical components 25 or 44 (as shown in FIG. 6). The optical components position maybe adjustable in the X, Y, or Z axis. The core 27 surrounds the circuit boards 21 and is cut out in the areas where the circuit boards 21 and LEDs 19 are placed. The core 27 is affixed to the upper skin layer 15 by adhesive epoxy or thermal film 23. In the areas where the core 27 has been removed, a window 17 is placed as part of the upper skin layer 15 so that the light from the LEDs 19 may illuminate the desired area.

FIG. 5 shows an exterior view of the LED light panel 11. The exterior of the LED light fixture/panel 11 is composed of the lower skin layer 13 and the upper skin layer 15. The LEDs 19 are allowed to emit through the upper skin layer 15 via windows 17. Internally, the LED light panel 11 contains power supply 33. In cases where an external power source is unavailable or goes out, the LED light fixture/panel 11 may also have an internal battery 34. The battery 34 may be used as a back-up or for emergency lighting. Also, emergency LEDs 39 may illuminate as not to draw down the batteries. FIG. 5 shows three emergency LEDs 39, but any number may be used. Additionally, the LED light fixture/panel 11 may also contain optional air vents or forced air in order to further dissipate heat if required.

FIG. 5 also shows optional alignment pins 37. The alignment pins 37 may extend in the x, y, or z direction or be formed to any angle. The alignment pins 37 may also be used to DC power the panel when stacking or a matrix grid of panels is desired. Although alignment pins 37 are shown in FIG. 5, the LED light panel 11 may include alignment posts, pins, tube shapes for stacking LED light panels or adding additional LED light fixtures to a system. Redundancy LEDs can be added to the system so that if one LED goes out, then another illuminates, thus adding additional time before the panel replacement for difficult locations such as towers. The attaching and alignment to an LED light panel 11 may complete a ceiling grid, a wall of LED light fixtures, or a floor in any plane of the X, Y, or Z grid.

The LED light panel 11 may have connecting wires 41 or connectors 48 that connect from the power supply 33 to an external electrical system. The connectors may provide power, data, or combination of both to the internal circuits. Sources of power include batteries, solar panels, wind generators, power supplies, and commercial, industrial, and residential AC power. The connecting wires 41 may be the only component that is outside of the housing of the LED light panel 11. Since all of the components may be included in a lightweight panel with only the connecting wires 41 or connector, or internal contacts, 45 to be connected, installation is simplified, and labor is reduced when a replacement is needed.

The surfaces of the exterior of LED light panel 11 may be plated, hard coated, painted, brushed, anodized, or powder coated with multiple finishes and coating configurations. Also, other desirable coatings or material layers may be added to the panel for decorative purposes. For example, louvers may be added to the outside to enhance the appearance and control luminance of transmitted light from the panel/fixture 11.

FIG. 6 illustrates some of the major components of LED light panel 11. First, the lower skin layer 13 can be made of any material with proper heat transfer properties. Aluminum and copper are common examples. On the other end, the panel 11 has an upper skin layer 15 with a window 17. The window 17 shown accommodates a circular pattern of LEDs 19, but it can be cut into any shape. Upper skin layer 15 may be made of plastic or metal as required. It may also be textured or have other material added on.

Circuit board 21 is affixed to the lower skin layer 13. The circuit board 21 may be any shape. FIG. 6 shows circuit board 21 in square, round, and straight patterns. These shapes accommodate any pattern for the LEDs 19, which are electrically connected to the circuit board 21. The circuit board 21 may be designed with on board components and drivers as required by each application.

Core 27 is in thermal contact with the LEDs 19. As shown in FIG. 6, an inner cavity is cut out from core 27 in the location of the LEDs 19 with a round pattern. The inner cavity of core 27 can be cut to any shape so that it corresponds with the pattern of LEDs 19. In addition, the inner cavity of core 27 could be cut for each individual LED 19 to form an alternating array of core 27 and LED 19.

FIG. 7 is a decorative panel/fixture 11 which has a lower skin layer 13 affixed to aluminum shape 65 and reflector 69 by an adhesive, epoxy or thermal film 23. Beneath the reflector 69 may be a conductive foam 67 to provide stiffness and conduct to the panel 11 and lower skin layer 13. The upper skin layer 15 may have a decorative screen 72, such as a picture, negative, or image affixed to the face. The upper skin layer 15 is attached by adhesive, epoxy or thermal film 23. Reflector 69 may include graphic film 75 as required for visual effects. Also the graphic film 75 may be attached to protect the window(s) 17 from ultraviolet light. The angle is adjustable depending on light transmission distribution.

Figure 8A:
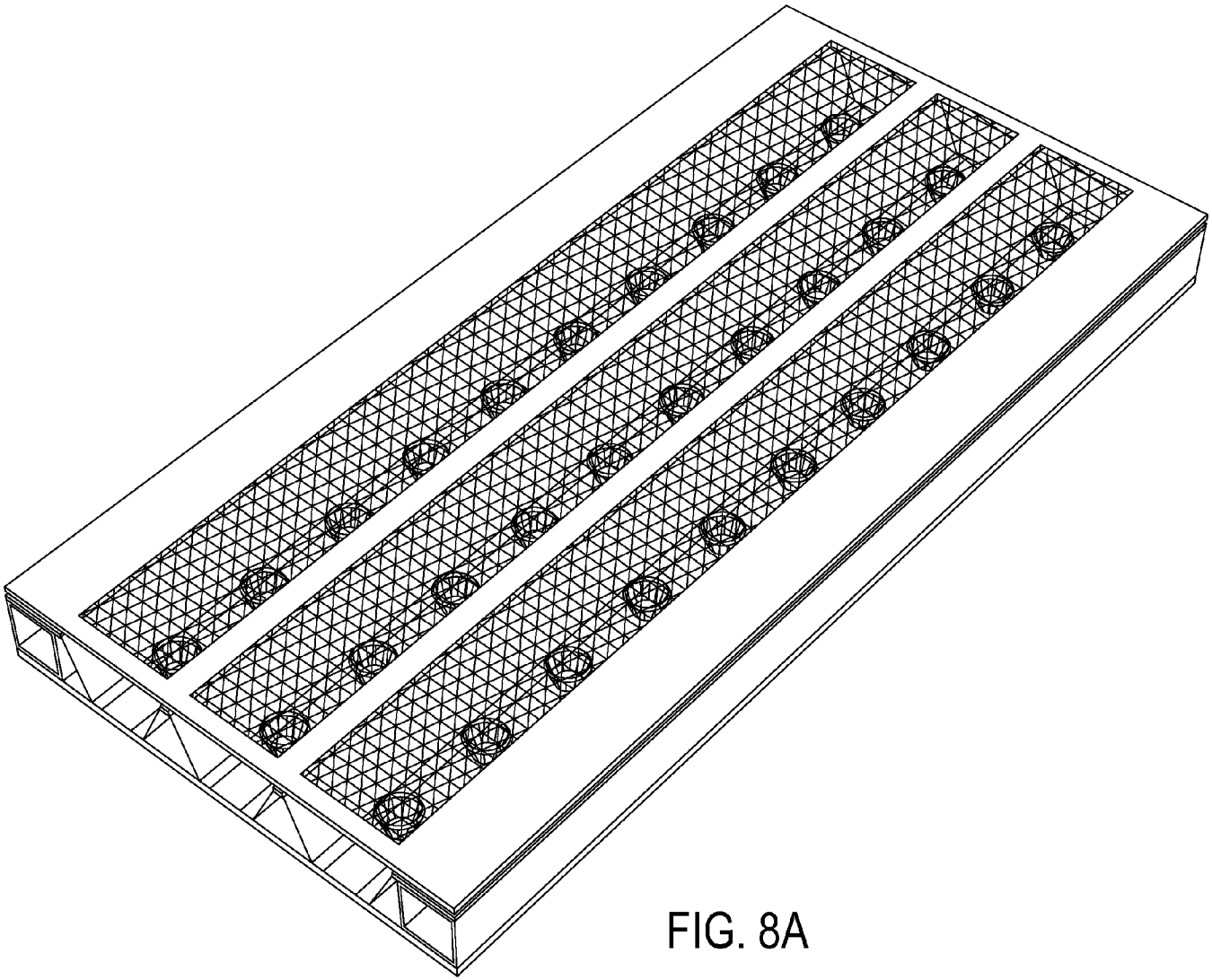
FIG. 8A is a three dimensional view of an alternative embodiment of an LED light fixture/panel in accordance with the present invention.

In FIG. 8, a multiple reflector LED panel/fixture 11 has LEDs 19 connected to the printed circuit board 21, and the printed circuit board 21 is thermo epoxied to the reflector 59. The reflector 59, components, and square tube shape 58 are attached with adhesive, epoxy, or thermal film 23 to the upper skin layer 15. The upper skin layer 15 has several windows 17 above the LEDs 19. Lower skin layer 13 and tube shape 58 are optional.

Figure 9A:
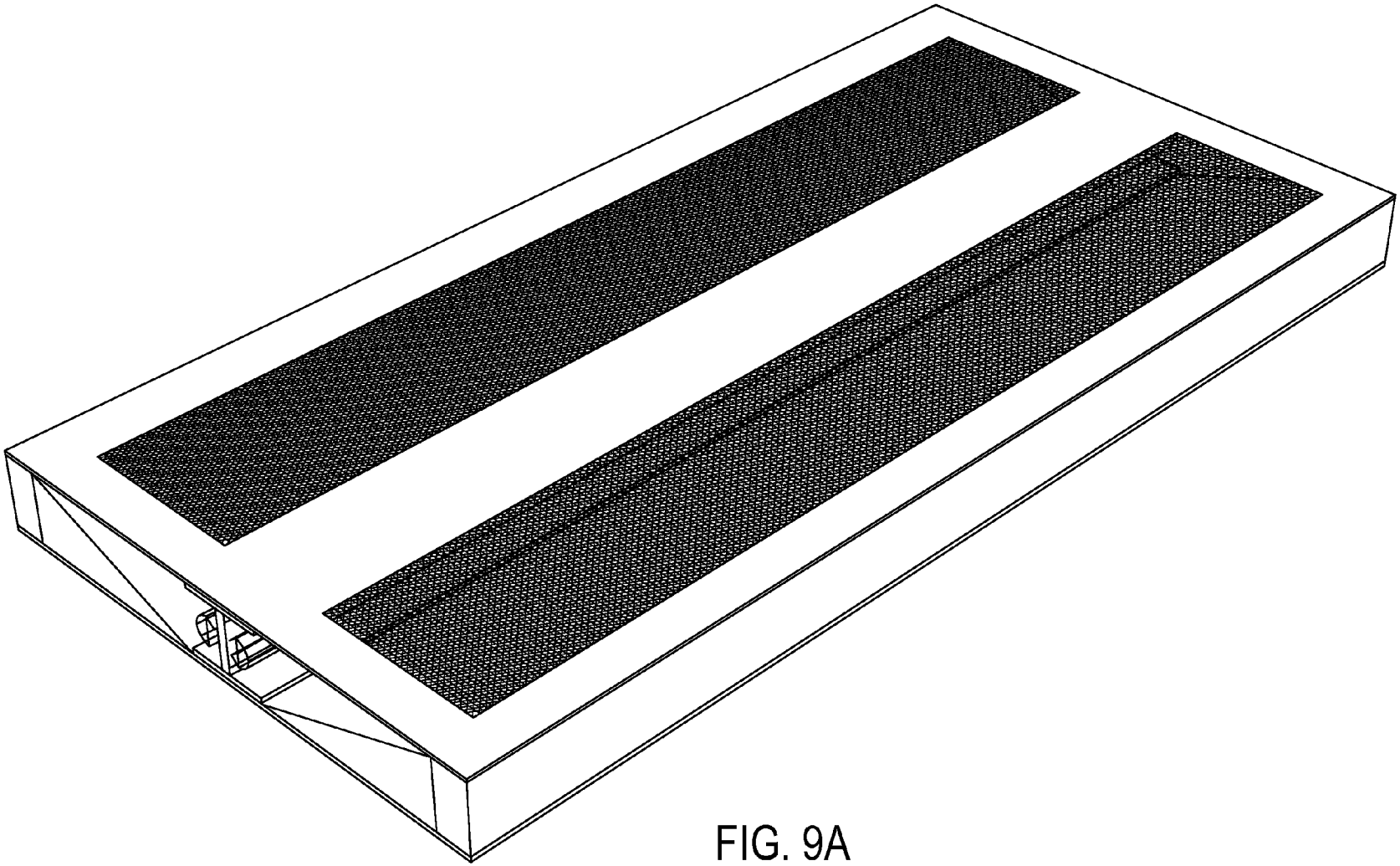
FIG. 9A is a three dimensional view of an alternative embodiment of an LED light fixture/panel in accordance with the present invention.

In FIG. 9, H Beam shape 64 has LEDs 19 electronically connected to a printed circuit board 21. The printed circuit board 21 is affixed to the H Beam shape 64 with thermal epoxy 23. Optical components or lenses 44 provide light distribution to the reflector 61. Window 17 allows light distribution from the reflector 61. Metal shape 68 and lower skin layer 13 are optional. Optical components or lenses 44 may be required dependent on light distribution desired and may be adjustable in position in the X, Y, or Z plane.

In FIG. 10, lower skin layer 13 is attached to the upper skin layer 15 with adhesive, epoxy, or thermal skin 23. In addition, clear plastic shape 60 is affixed to the upper skin layer 15 and lower skin layer 13 with adhesive, epoxy, or thermal film 23. Reflector 61 may be metal or plastic. Reflector 61 can be any angle desired and is a triangular shape. LEDs 19 and circuit board 21 are affixed to the upper skin layer 15 with adhesive, epoxy or thermal film 23. In addition, windows 17 are affixed to the upper skin layer 15 with adhesive, epoxy or thermal film 23. The embodiment in this configuration provides for the illumination of plastic edge 60 and window 17.

FIG. 11 shows an embodiment for a stoplight 55 in accordance with the present invention. Three circular LEDs 19 and circuit boards 21 are affixed to the lower skin layer 13 by a thermo adhesive, epoxy, or thermal film 23 in location 54, 56, and 57. Each circuit board 21 has a plurality of red LEDs in location 54, a plurality of yellow LEDs in location 56, and a plurality of green LEDs in location 57. The core 27 has three circular holes cut to allow the LEDs 19 and circuit boards 21 to be mounted in the cavity and affixed to the lower skin layer 13 via an adhesive, epoxy, or thermal film 23. The upper skin layer 15 has three circular holes cut to allow light transmission from the LEDs 19 through the window 17. A shaft 53 is inserted through a square shape and round bushing 81 in order to pivot or hang the fixture/panel 11.

In FIG. 12, the upper skin layer 15 is formed to a fixture/panel 11. Windows 17 are affixed to the upper skin layer 15 by adhesive, epoxy, or thermal film 23. The LEDs 19 and circuit board 21 are affixed to the formed, right angle lower skin layer 13 by adhesive, epoxy or thermal film 23. This embodiment of a formed fixture panel illuminates in the horizontal and vertical plane.

Figure 12A:
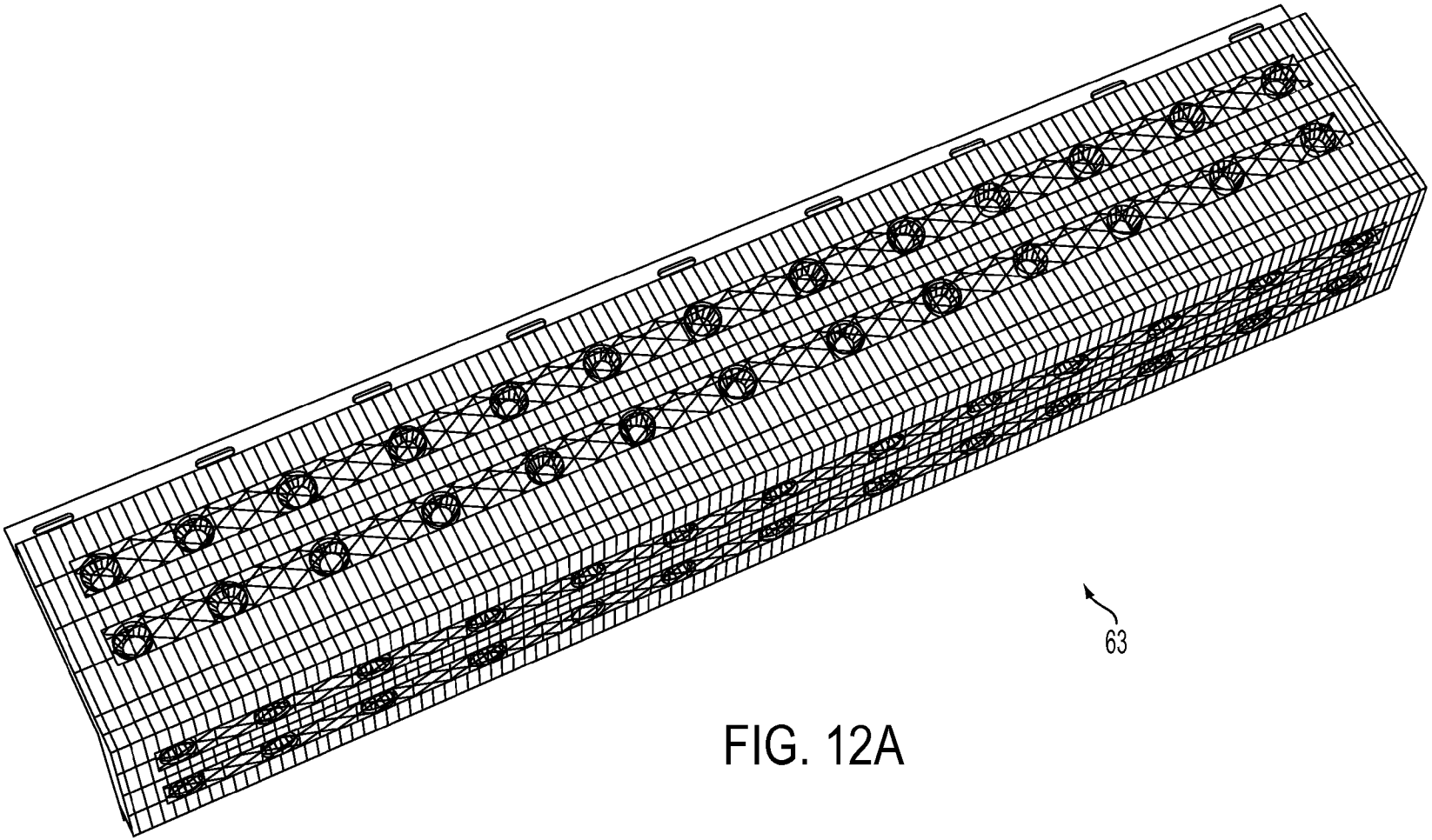
FIG. 12A is a three dimensional view of an alternative embodiment of an LED light fixture/panel in accordance with the present invention.

FIG. 12A shows a length 63 of the above fixture/panel of the above embodiment.

FIG. 13 shows upper skin layer 15 with flanges 50 for recess mounting the fixture/panel 11.

FIG. 14 shows lower skin layer 13 with flanges 51 for surface mounting the fixture/panel 11.

Figure 15:
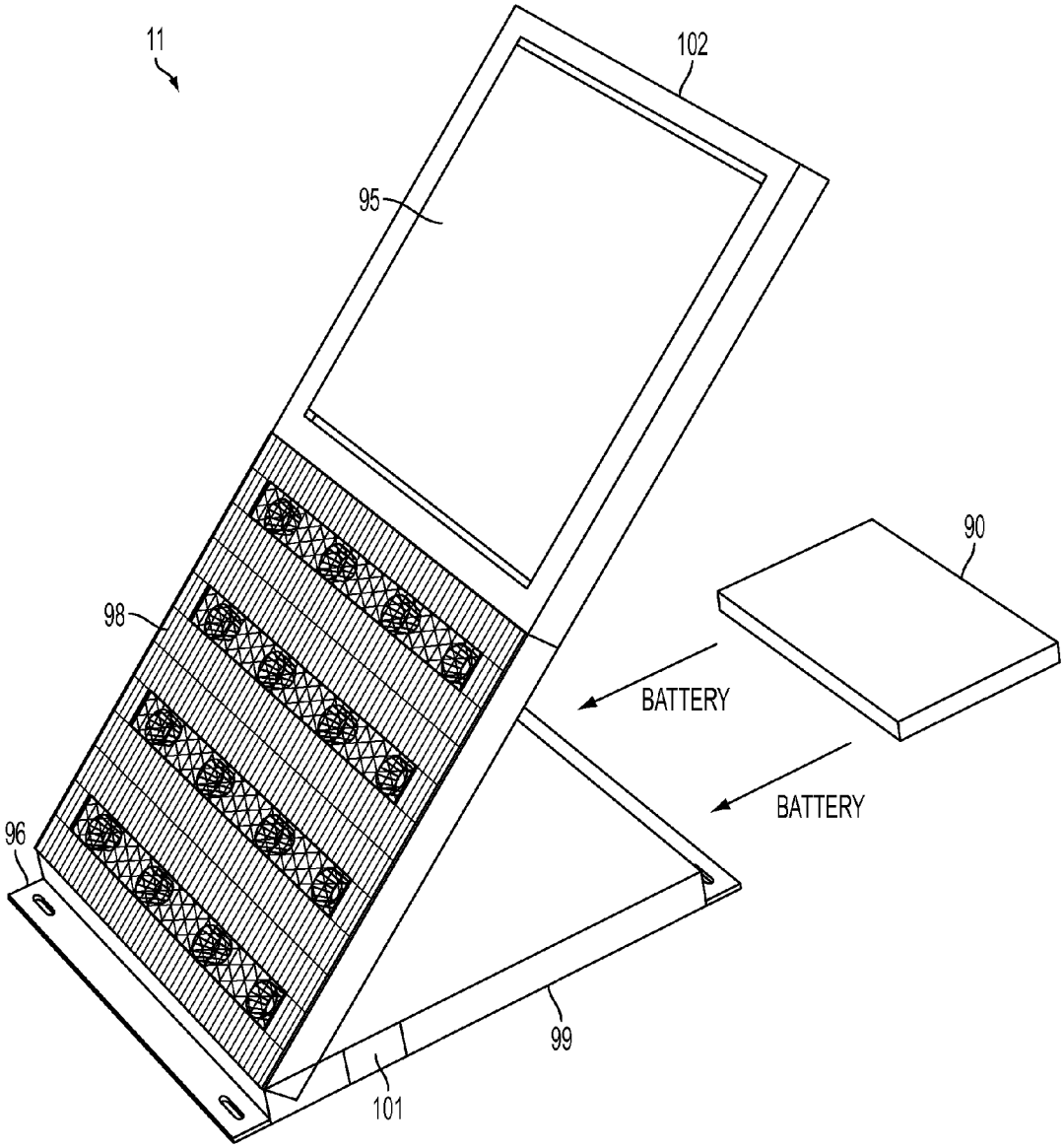
FIG. 15 is a three dimensional view of an alternative embodiment of an LED light fixture/panel in accordance with the present invention.
Figure 15A:
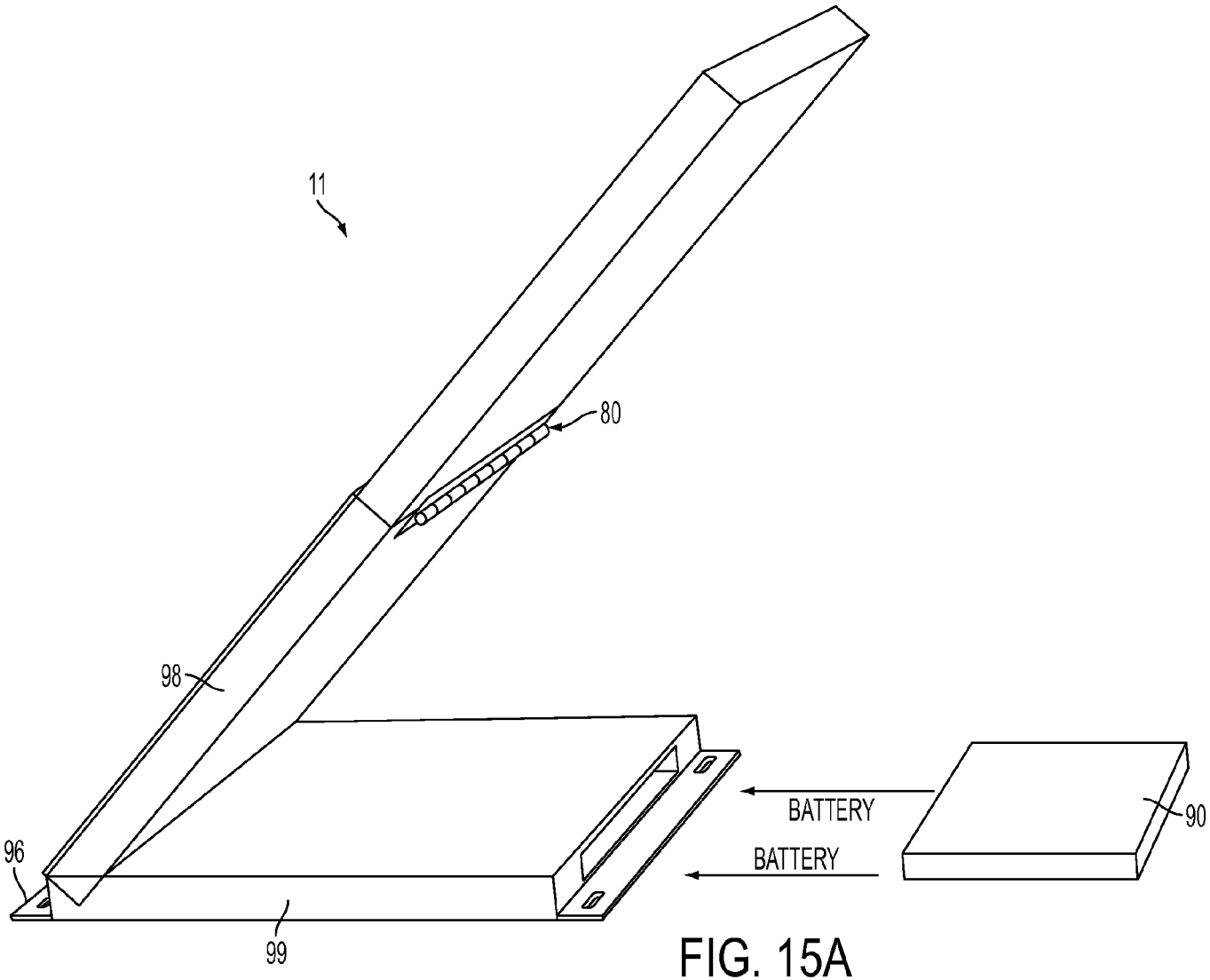
FIG. 15A is a three dimensional view of an alternative embodiment of an LED light fixture/panel in accordance with the present invention.

FIGS. 15 and 15A show an embodiment configuration comprising a combination of system components. The fixture/panel 11 consists of two panels, a top panel 98 and a bottom panel 99. Solar panel 95 is located within the fixture/panel 11 and hinged by hinge 80 for movement. Also, a section of the panel 11 contains another embodiment of the LED light fixture/panel 11 formed to a bottom panel 99. Inside the panel 11 is a solar changing and photo eye 102. The bottom panel 99 contains a circuit board 101 and a modular battery 90. The fixture/panel 11 can be mounted using mounting flange 96.

Figure 16A:
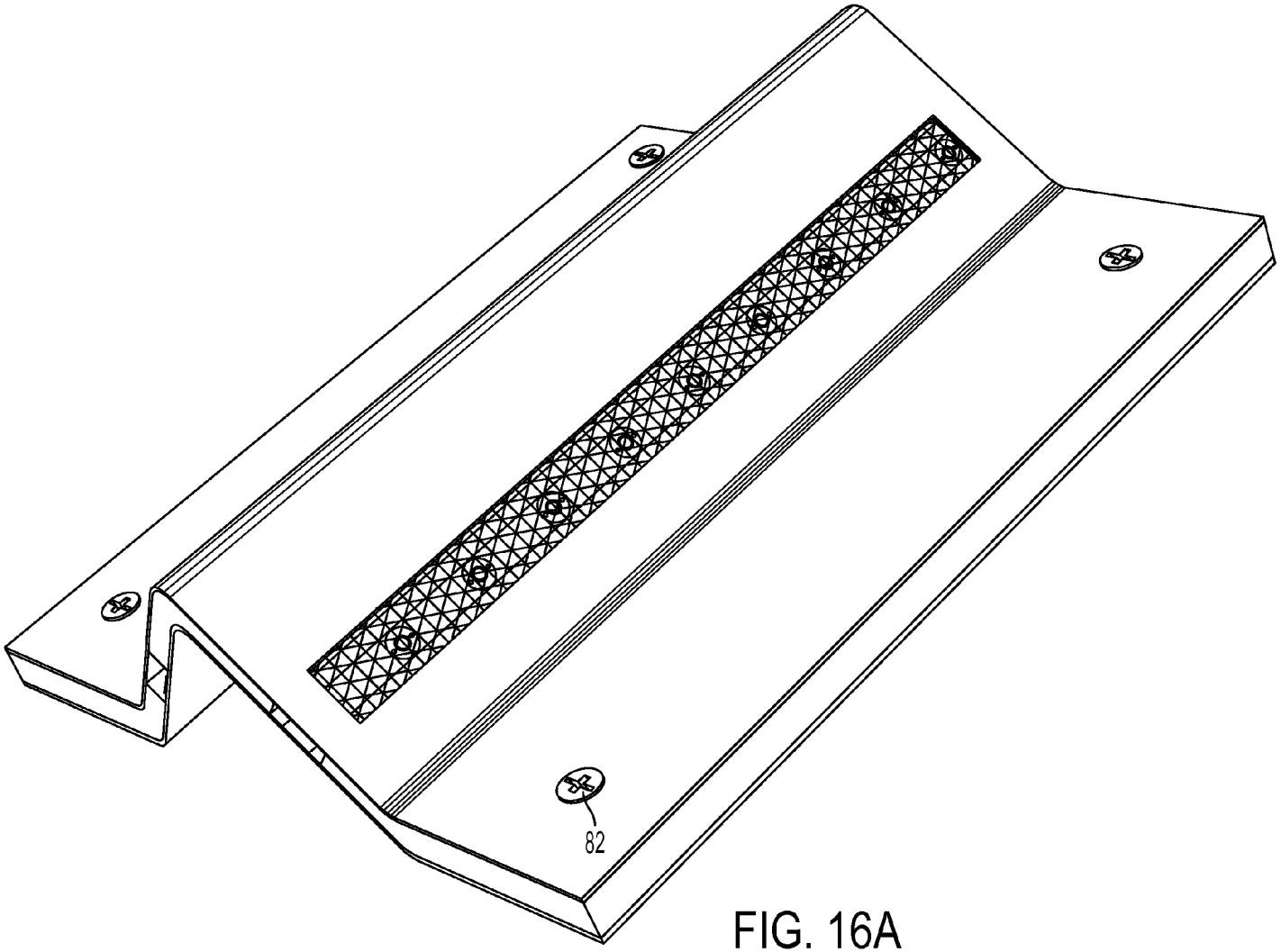
FIG. 16A is a three dimensional view of an alternative embodiment of an LED light fixture/panel in accordance with the present invention.

FIG. 16 shows a formed upper skin layer 15 and lower skin layer 13 conforming to a V structure panel with LEDs 19 and circuit board 21. The V structured panel 11 is attached with fastener 82.

FIG. 17 shows a LED fixture 125 mounted thru a honeycomb panel.

Figure 18:
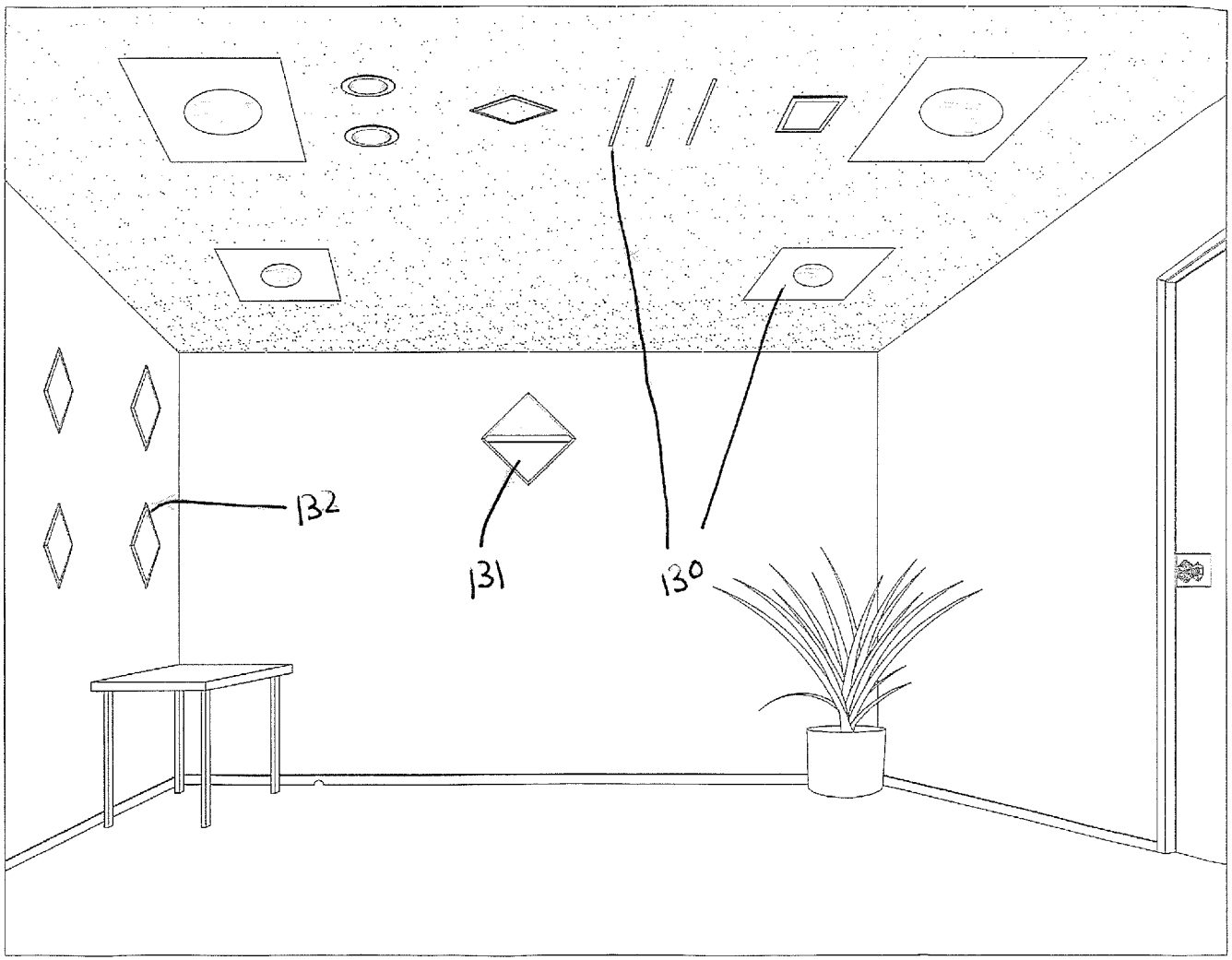
FIG. 18 is a three dimensional view of an alternative embodiment perspective of an LED light fixture/panel in accordance with the present invention.

FIG. 18 has several embodiments of the present invention combined. Shown are several configurations of hanging ceiling panels 130, wall sconce 131, and wall panel 132.

One important aspect of the present invention is its ability to conduct heat away from the LEDs 19. This characteristic is achieved by the core 27. The core 27 is in thermal contact with the LEDs 19 to dissipate the heat that the LEDs 19 produce. By dissipating the heat, the lifespan of the LEDs 19 is increased. The core 27 operates as a heat sink due to its large surface area. The large surface area increases the heat dissipation rate as compared to prior art devices without the core 27 of the present invention. For high-powered applications, additional heat sinks may be added on the rear of the LEDs 19 on the upper skin layer 15 or lower skin layer 13. The density of the core 27 and cell size may be decreased and the cell thickness increased for better heat conduction if required.

Another aspect of the present invention is that it may be waterproof depending on the application. Adhesive, epoxy, or thermal film 23 is waterproof which creates a watertight seal around all of the components in the LED light panel 11.

Similarly, the present invention may be configured in rigidity, stability, and toughness. As described above, increased structural integrity can be achieved by installing standoffs, aluminum shapes, or increase core density between the lower skin layer 13, upper skin layer 15, and window 17. It can also be weather resistant, flame resistant, and corrosion resistant. It may also have thermal control, sound control, other custom configuration, or any combination thereof. Because of the versatile nature of the present invention, many techniques known in the art can be applied to the present invention so that it can be used in any environment. As further examples, the LED light fixture/panel 11 can be configured for acoustics, and the lower skin layer 13 and upper skin layer 15 may be any color or shape and may be perforated for sound.

The present invention has many applications. In large-scale systems, it may be utilized as, or in addition to, walls, ceilings, or floors. It can be configured to rounded, v strips, corners, flat strips, rectangles, squares, triangles, formed sheet metal, or any configuration desired. The present invention can be manufactured as flat, formed, or any dimensional configuration required. In addition, it can be surface mounted or recessed. Other mechanical devices may be added to the formed or flat surfaces for cosmetic appearances.

Because of the novel design of the present invention, it can be a stand-alone, a ceiling fixture, a hanging ceiling panel, a complete system of ceiling panels/fixtures, signage, furniture, an aquarium illuminating cover, artwork, or it can be cut to size to fit inside an existing conventional lighting fixture. The present invention can be used on or as a wall, ceiling, floor, or configured to be a complete structural system. It also can be used in conjunction with a prior art panel. The present invention can be assembled and formed into any dimensional product. For example, the present invention can be shaped to be a square or rectangular box, a pyramid, a structural system with four walls and a ceiling, or any custom shape configuration. In other words, the present invention may be cut, trimmed, or formed into a two or three-dimensional object of any length, width, thickness, or shape. It can be a single fixture panel, ganged assembled, or stacked together to form a structural system. It may be formed to walls, ceilings, floors, or custom structures.

The versatility of the present invention allows it to be used indoors or outdoors. Its structural integrity and durability makes it perfect for military, industrial, commercial, transportation, aircraft, and residential use. If designed to be waterproof, it can be used for marine applications. The present invention can also be antimagnetic by using antimagnetic materials, which allows it to be used in all areas of a medical facility such as MRI rooms. The design of the present invention allows it to be used in any setting.

Known LED ceiling tiles must be low power due to their design. If they were high power, the LEDs would burn out because of the lack of heat transfer. Known LED ceiling tiles are also bulky and heavy. When dropped, they easily break. In contrast, the present invention uses lightweight materials that transfer the heat away from the LEDs 19.

The present invention described above and shown in FIGS. 1-18 provide the most functions at the lowest cost while maintaining good thermal conductivity, component standardization, and minimum weight. It may be used for both utilitarian and decorative purposes.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling with the scope of the appended claims.

What is claimed is:

1. A lighting panel having a supporting structure providing more efficient heat transfer for one or more light sources, the lighting panel comprising:

a lower skin layer and an upper skin layer encapsulating one or more light sources, the lower skin layer connected to a bottom surface of the one or more light sources, the one or more light sources producing heat;

a structure located between and connected to each of the lower skin layer and the upper skin layer, the structure having a plurality of cells, two or more cells of the plurality of the cells surrounding the one or more light sources; and wherein the structure comprises a thickness, a shape and the plurality of cells constructed to provide a predetermined heat conductivity, and the heat produced from the one or more light sources is distributed via the structure to the lower skin layer and the upper skin layer.

2. The lighting panel of claim 1, further comprising a heat producing device enclosed between and connected to at least one of the lower skin layer or the upper skin layer, the heat producing device surrounded by two or more cells of the plurality of cells, the heat produced by the heat producing device distributed via the structure to the lower skin layer and the upper skin layer.

3. The lighting panel of claim 2, wherein the heat producing device comprises at least one of a printed circuit board, an audio/video circuitry, a wireless transmitter, a motion detector, or a temperature monitoring circuitry.

4. The lighting panel of claim 1, wherein the structure further comprises at least a portion of the plurality of cells of the structure interfacing with the lower skin layer.

5. The lighting panel of claim 4, wherein construction of the thickness, shape and the plurality of cells of the structure provides an increased sturdiness.

6. The lighting panel of claim 1, wherein at least one of the lower skin layer, upper skin layer or the structure comprises a metal.

7. The lighting panel of claim 6, wherein at least one of the lower skin layer, upper skin layer or the structure comprises aluminum.

8. The lighting panel of claim 1, wherein at least a portion of the upper skin layer comprises a transparent cover.

9. The lighting panel of claim 1, wherein at least a portion of the upper skin layer interfaces with a transparent cover.

10. The lighting panel of claim 1, further comprising a reflector interfacing with the lower skin layer and the upper skin layer, the reflector surrounding the one or more light sources and reflecting light emitted by the one or more light sources.

11. The lighting panel of claim 1, wherein the shape of the structure comprises a honeycomb.

12. The lighting panel of claim 1, wherein the shape of the structure comprises an egg crate.

13. The lighting panel of claim 1, wherein at least one cell of the plurality of cells of the structure comprises a louver.

14. The lighting panel of claim 1, wherein at least one cell of the plurality of cells of the structure comprises one of an I beam or a stand off.

15. The lighting panel of claim 1, wherein at least one cell of the plurality of cells of the structure comprises a channel.

16. The lighting panel of claim 1, wherein at least one cell of the plurality of cells of the structure comprises a threaded insert.

17. The lighting panel of claim 1, further comprising locative pins for connecting the lighting panel with another lighting panel.

18. A panel having a supporting structure providing more efficient heat transfer for one or more heat producing elements, the panel comprising:

a lower skin layer and an upper skin layer encapsulating one or more heat producing elements, the lower skin layer connected to a surface of the one or more heat producing elements;

a structure located between and connected to each of the lower skin layer and the upper skin layer, the structure having a plurality of cells, two or more cells of the plurality of the cells surrounding the one or more heat producing elements; and wherein the structure comprises a thickness, a shape and the plurality of cells constructed to provide a predetermined heat conductivity, the heat produced from the one or more heat producing elements is distributed via the structure to the lower skin layer and the upper skin layer.

19. The panel of claim 18, wherein the one or more heat producing elements comprises at least one of a printed circuit board, an audio/video circuitry, a wireless transmitter, a motion detector, or a temperature monitoring circuitry.

20. The panel of claim 18, wherein the one or more heat producing elements comprises a battery.

21. The panel of claim 18, wherein the structure further comprises at least a portion of the plurality of cells of the structure interfacing with the lower skin layer.

22. The panel of claim 21, wherein construction of the thickness, shape and the plurality of cells of the structure provides an increased sturdiness.

23. The panel of claim 18, wherein at least a portion of the upper skin layer comprises a transparent cover.

24. The panel of claim 18, wherein at least a portion of the upper skin layer interfaces with a transparent cover.

25. The panel of claim 18, wherein the one or more heat producing elements are enclosed within the structure.

26. The panel of claim 18, wherein at least one of the lower skin layer, upper skin layer or the structure comprises a metal.

27. The panel of claim 26, wherein at least one of the lower skin layer, upper skin layer or the structure comprises aluminum.

28. The panel of claim 18, wherein the shape of the structure comprises a honeycomb.

29. The panel of claim 18, wherein the shape of the structure comprises an egg crate.

30. The panel of claim 18, wherein at least one cell of the plurality of cells of the structure comprises a louver.

31. The panel of claim 18, wherein at least one cell of the plurality of cells of the structure comprises one of an I beam or a stand off.

32. The panel of claim 18, wherein at least one cell of the plurality of cells of the structure comprises a channel.

33. The panel of claim 18, wherein at least one cell of the plurality of cells of the structure comprises a threaded insert.

34. The panel of claim 18, further comprising locative pins for connecting to another lighting panel.

* * * * *